United States Patent [19]

Takizawa et al.

[11] 3,969,807

[45] July 20, 1976

[54] CORE WIRE-CONNECTING DEVICE

[75] Inventors: Jun Takizawa, Tokyo; Kazuyuki Oshima, Kawasaki; Hikaru Yamamoto, Chiba; Kooji Kuribayashi, Ichihara; Toshio Suzuki, Kamakura, all of Japan

[73] Assignees: Nippon Telegraph and Telephone Public Corporation; The Fujikura Cable Works, Ltd.; The Furukawa Electric Co., Ltd., all of Tokyo; Sumitomo Electric Industries, Ltd., Osaka, all of Japan

[22] Filed: Dec. 31, 1975

[21] Appl. No.: 645,886

[52] U.S. Cl. ..... 29/203 DT; 29/203 C; 29/203 P; 29/628

[51] Int. Cl.[2] ..... H01R 43/04

[58] Field of Search ..... 29/203 D, 203 DT, 203 DS, 29/203 C, 203 R, 203 P, 628

[56] References Cited

UNITED STATES PATENTS

| | | | |
|---|---|---|---|
| 3,249,908 | 5/1966 | Fuller et al. | 339/98 |
| 3,263,316 | 8/1966 | Schrader | 29/203 DT |

*Primary Examiner*—Carl E. Hall

*Attorney, Agent, or Firm*—Flynn & Frishauf

[57] ABSTRACT

A core wire-connecting device has a reciprocative housing; a rotor rotatably mounted therein and having a plurality of front receptacles and the same number of rear receptacles formed in mutual alignment in the peripheral surface of the rotor equidistantly in a circumferential direction; a connector disengaging member for inserting a connector constituted by a sleeve and a conical wedge received therein into the front receptacle in a first position of the rotor; a wedge-removing member disposed ahead of the rotor in alignment with the front receptacle in the first position of the rotor so as to force the conical wedge received in the sleeve placed in the receptacle into the corresponding rear receptacle; a core cutting-off mechanism disposed close to the front end of the rotor at the second position of the rotor spaced through a prescribed phase angle from the first position thereof in the rotating direction; a core-holding unit provided in front of the housing to support core wires except when the rotor is rotated; a wedge-inserting member disposed at the rear end of the rotor in alignment with the rear receptacle in the second position of the rotor so as to force the conical wedge held in the rear receptacle in the second position of the rotor into the sleeve placed in the corresponding front receptacle; and a rotation unit disposed ahead of the rotor for joint rotation therewith so as to horizontally revolve the core wires jointly with the rotor, thereby automatically connecting the end portions of the core wires.

36 Claims, 40 Drawing Figures

FIG. 16
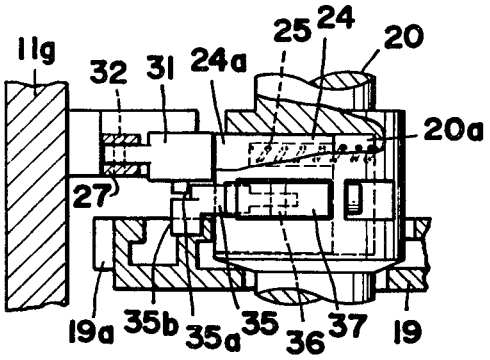
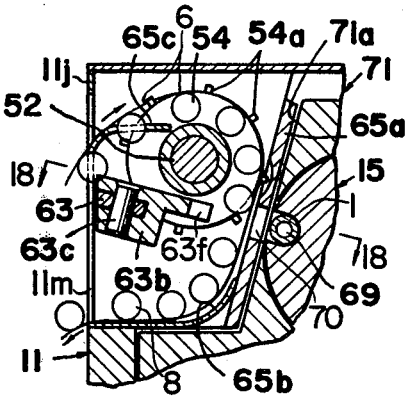
FIG. 17
FIG. 18
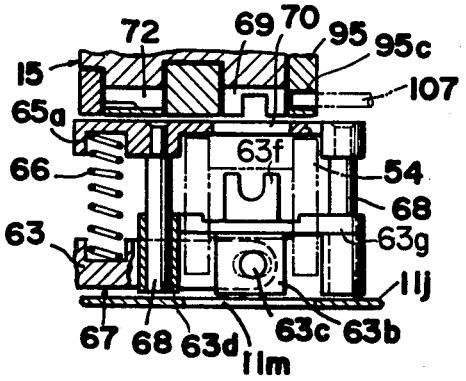

CORE WIRE-CONNECTING DEVICE

This invention relates to a device for automatically connecting the core wires of a telecommunication cable such as a telephone line.

Hitherto, an operator has manually connected core wires by inserting into a connector those end portions of the core wires which are to be joined together. The core wires of a telecommunication cable laid in an underground duct are connected by an operator in a manhole. However, the manhole has a narrow space and moreover is dark inside, possibly resulting in the loss of a connector and providing too unwholesome an environment for an operator to work long therein. Further, the connector which is designed to connect fine cable core wires generally has such a small size as about 5 mm in outer diameter and about 11 mm long, presenting considerable difficulties in manual handling.

The primary object of this invention is to provide a core wire-connecting device which automatically effects the operation of inserting core wires into a connector and fixing them in the joined state, thereby releasing an operator from the troublesome work of inserting into a small connector those end portions of core wires which are to be joined together, and also reducing his physical and mental stresses.

Another object of the invention is to provide a core wire-connecting device which saves an operator from the manual handling of a connector, thereby eliminating the possibility of the connector being lost, for example, in a manhole and decreasing his work time therein.

Still another object of the invention is to provide a core wire-connecting device which makes it unnecessary for an operator to achieve advanced skill with respect to the connection of core wires and the handling of a connector and moreover always enables core wires to be connected together under the same conditions.

SUMMARY OF THE INVENTION

According to this invention, there is provided a core wire-connecting device which comprises a driving shaft and main shaft rotatably received in a fixed housing in parallel relationship with each other; a movable housing reciprocatively mounted on the main shaft; a rotor reciprocating therewith and capable of rotating with the main shaft; a plurality of connector receptacle means formed in the periphery of the rotor equidistantly spaced in a circumferential direction to receive connectors each formed of a sleeve and a conical wedge received therein; intermittent rotation means provided between the main shaft and driving shaft so as to intermittently rotate the main shaft, together with the rotor through an angle defined by the respective adjacent receptacle means with the main shaft, each time the driving shaft is rotated through a prescribed angle; reciprocating means for moving the rotor back and forth along the main shaft when the main shaft is not rotated by the intermittent rotation means and for bringing core wires into the sleeve; connector-feeding mechanism for delivering connectors one by one from a belt-like magazine on which the connectors are arranged equidistantly lengthwise in parallel with each other to any of the receptacle means when said any of the receptacle means is brought to a first station of said movable housing; conical wedge-removing means disposed at one end of the rotor in alignment with the receptacle means at said first station so as to push the conical wedge out of the sleeve of the connector received in said receptacle means to the other end of the rotor; a core cutting-off mechanism mounted on the movable housing in alignment with the receptacle means disposed near said one end of the rotor at a second station of said movable housing which is circumferentially separated from said first station through an angle corresponding to an angle extended between adjacent front receptacles with respect to the axis of said rotor so as to cut off the unnecessary parts of the joinable end portions of the core wires, thereby allowing the tips of the cut-off ends of the core wires to be brought into alignment; conical wedge-inserting means provided at the other end of the rotor in alignment with the receptacle means at said second station so as to insert the conical wedge into the sleeve; driving means for carrying the conical wedge-inserting means toward said one end of the rotor to an extent corresponding to the distance through which the conical wedge-inserting means pushes the conical wedge now released from the sleeve received in the receptacle means at said second station; and coreholding means for immovably supporting the core wires lengthwise of the main shaft.

BRIEF DESCRIPTION OF THE DRAWINGS

This invention can be more fully understood from the following detailed description when taken in conjunction with the accompanying drawings, in which:

FIG. 16 is a fractional bottom view, partly in section, of FIG. 14;

FIG. 17 is an enlarged sectional view on line 17—17 of FIG. 7;

FIG. 18 is a sectional view on line 18—18 of FIG. 17;

DETAILED DESCRIPTION

Figure 1:
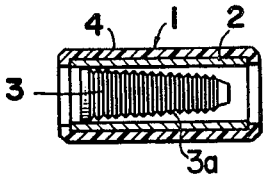
FIG. 1 is a longitudinal sectional view of a connector used with a core wire-connecting device according to this invention.
Figure 2:
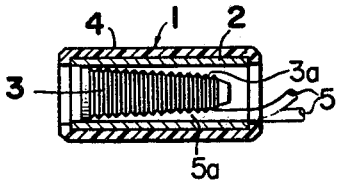
FIG. 2 is a longitudinal sectional view showing the manner in which the connecting end portions of core wires are joined together by the connector of FIG. 1.
Figure 3:
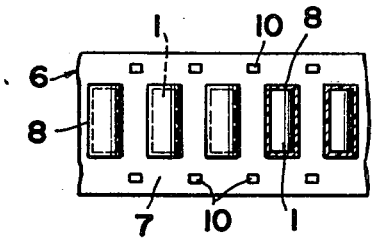
FIG. 3 is a plan view of a magazine in which plural units of the connector of FIG. 1 are received.
Figure 4:
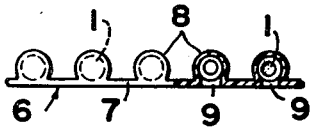
FIG. 4 is a front view, partly in section, of the magazine of FIG. 3.

Referring to FIG. 1 a connector 1 for connecting the end portions of core wires of a telecommunication cable comprises a cylindrical sleeve 2 (generally measuring 3 mm in inner diameter, 4 mm in outer diameter and 10 mm in length) made of copper, aluminium, alloy thereof or any other conductive metal; an electrical insulation covering 4 of, for example, plastics material about 0.5 mm thick which is mounted on the outer surface and both lateral edge portions of the cylindrical sleeve 2; and a conical wedge 3 made of the same material as that of the sleeve 2 and having a maximum diameter substantially equal to the inner diameter of the sleeve 2 and a length slightly (for example, 2 to 3 mm) shorter than that of the sleeve 2. The peripheral surface of the conical wedge 3 is provided with a plurality of annular ridges 3*a* having a triangular cross section. First, the conical wedge 3 is drawn out of the sleeve 2, and then the joinable end portions 5*a* of the core wires 5 of a telecommunication cable are inserted into the sleeve 2. When the conical wedge 3 is forcefully pushed into the sleeve 2, the annular ridges 3*a* of the wedge 3 break away an electrical insulation layer on the joinable end portions 5*a* of the core wires 5 and bite into the underlying conductors, thereby firmly joining the end portions 5*a* electrically as well as mechanically.

A magazine 6 comprises a thin flexible connector belt 7 formed of plastics material, metal, paper or a laminate thereof or any other flexible material and a plurality of hollow cylindrical connector containers 8 spatially arranged lengthwise of the connector belt 7 and each extending at right angles to the lengthwise direction of the belt 7. Each connector container 8 is made of a wall thinner than the connector belt 7 so as to be readily deformed when depressed from above, thereby allowing the connector 1 received therein to be forced out of an opening 9 formed at the bottom of the container 8. A plurality of perforations 10 are bored in both lateral edge portions of the connector belt 7 to cause the magazine 6 to be intermittently carried forward through a prescribed distance. The magazine 6 eliminates the inconvenience of manually handling small connectors one by one and also the possibility of any of the connectors being lost during the core wire-connecting operation.

A device according to this invention for connecting the core wires of a telecommunication cable automatically carries out, as described below, the steps of taking connectors one after another out of the magazine 6; removing the conical wedge 3 from the sleeve 2 of the connector 1; drawing the joinable end portions 5*a* of two or more wires 5 into the sleeve 2 with the tips of the end portions set in a line; forcefully pushing the conical wedge 3 into the sleeve 2; and pulling the joined end portions 5*a* of the core wires 5 out of the connecting device.

FIGS. 5 to 33 illustrate a core wire-connecting device according to an embodiment of this invention. This device comprises a rotor 15 (FIGS. 6, 25 to 29) provided with front receptacles 69 (FIGS. 25, 27, 29) for receiving the connectors 1 and rear receptacles 72 (FIGS. 27, 28) for receiving the conical wedges 3 removed from the sleeves 2; a rotation unit 78 (FIGS. 6, 20 to 23) for supporting the joinable end portions 5*a* of plural core wires 5 which are properly pulled to have the tips set in a line and moving the end portions together with the rotor 15 in its circumferential direction; a wedge-removing member 107 (FIGS. 7, 18, 24) for releasing the conical wedge 3 from the sleeve 2; a core cutting-off mechanism 94 (FIG. 25) for cutting off the unnecessary tips of the joined end portions 5*a* of core wires 5; a coreholding unit 92 (FIGS. 21, 22) for immovably supporting the joined end portions 5*a* of core wires 5 at the time of the above-mentioned cutting; a wedge-inserted member 112 (FIGS. 6, 7, 24, 30, 31) for forcefully pushing the conical wedge 3 into the sleeve 2; a core-bending unit 109 (FIGS. 24, 27, 30, 31) for pulling the joinable end portions 5*a* of core wires 5 toward the center of the rotor 15 in the sleeve 2 and bending those parts of the end portions 5*a* which extend outside of the sleeve 2 toward the rotor center in a radial direction; and a connector-feeding mechanism 67 (FIG. 18) for shifting the magazine 6 to insert the connectors 1 one after another into each front receptacle 69 (FIGS. 17, 18, 24, 25, 27, 29).

Figure 5:
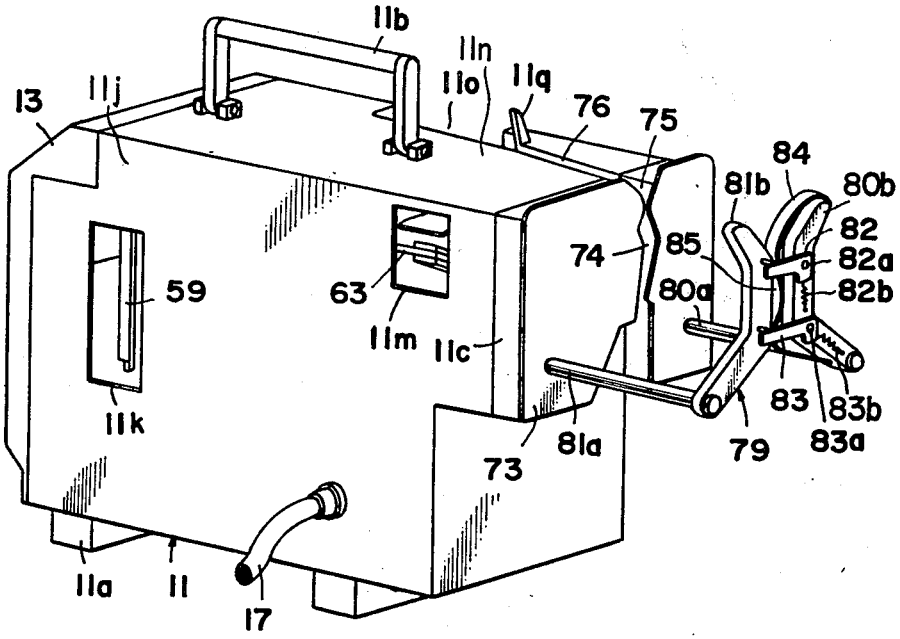
FIG. 5 is an oblique view of a core wire-connecting device embodying this invention.
Figure 6:
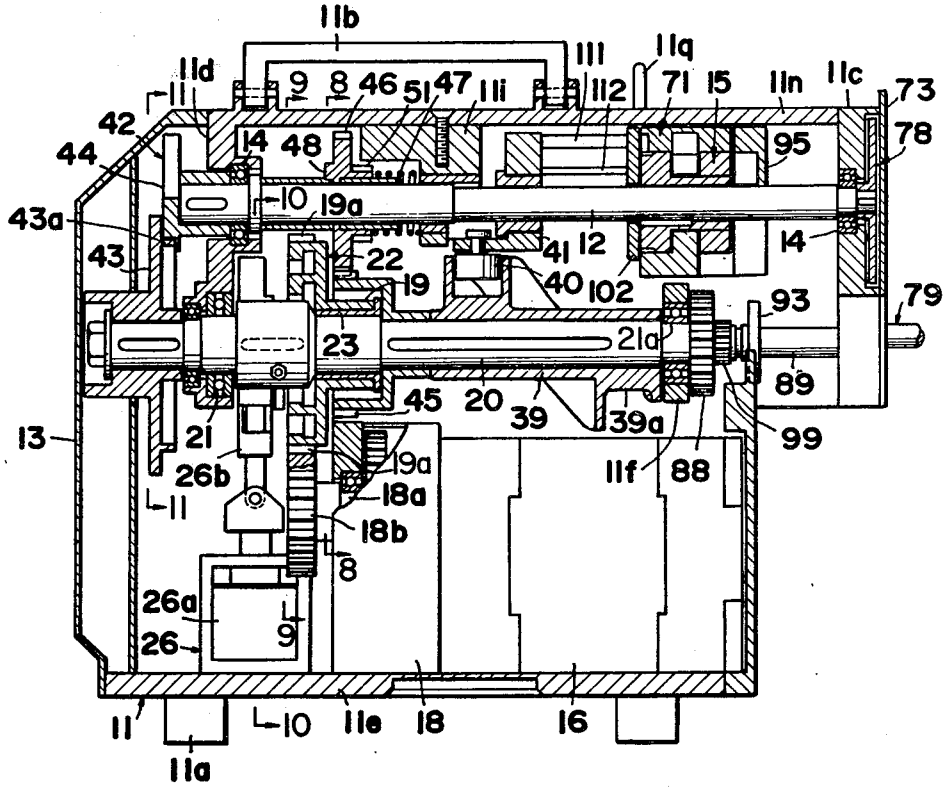
FIG. 6 is a lateral sectional view of FIG. 5.

A fixed housing 11 comprises, as shown in FIGS. 5 and 6, legs 11*a* and a handle 11*b*. In the housing 11, the main shaft 12 is supported horizontally and rotatably by means of bearings 14 on the front plate 11*c* and that part of the inner wall 11*d* of the housing 11 which is positioned near a rear plate 13. The rotor 15 is mounted on the main shaft 12 so as to move in its axial direction and rotate with the main shaft 12 (FIG. 6).

Reverting to FIG. 6, an electric motor 16 is set on the base plate 11*e* of the housing 11 and driven by current introduced through an electric wire 17 (FIG. 5) extending outside of the housing 11. The rotation of the electric motor 16 is transmitted to its output shaft 18*a* through a reduction unit 18. A gear 18*b* fixed on the output shaft 18*a* engages a gear portion 19*a* constituting an outermost element of a clutch driver unit 19 of a clutch mechanism 22.

Referring to FIG. 6, a drive shaft 20 extending parallel with the main shaft 12 is rotatably supported by means of bearings 21, 21*a* on the inner walls 11*d*, 11*f* of the housing 11. The clutch driver unit 19 is rotatably mounted on the drive shaft 20 by means of a collar 23. The clutch driver unit 19 comprises, as shown in FIGS. 9, 10, 14, 15, an outer cylindrical portion 19*b* and an inner cylindrical portion 19*c* formed integrally with the outer cylindrical portion 19*b* so as to surround the drive shaft 20. The outer cylindrical portion 19*b* has a gear provided on the outside and a plurality of first grooved engagement elements 19*e* formed in the inner wall equidistantly in the circumferential direction. The inner cylindrical portion 19*c* also has a plurality of second grooved engagement elements 19*d* formed in the inner wall equidistantly in the circumferential direction.

Figure 14:
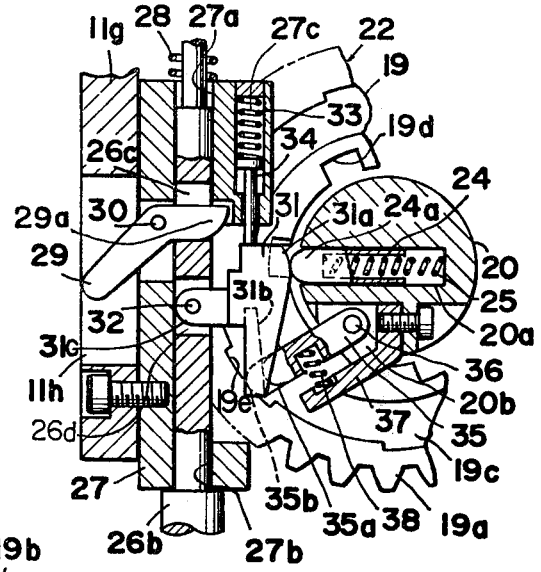
FIG. 14 is a fractional rear sectional view illustrating a clutch mechanism included in the core wire-connecting device.
Figure 15:
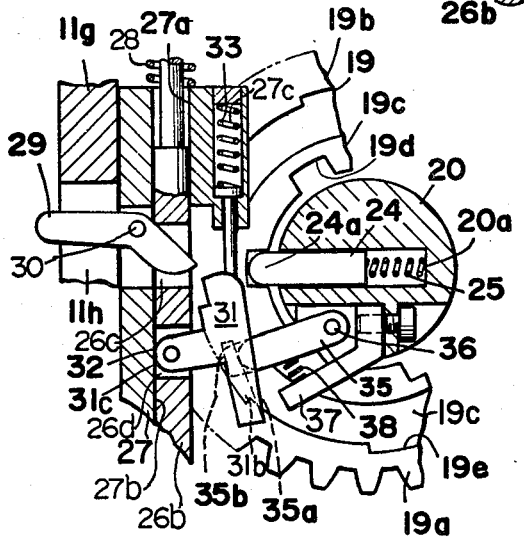
FIG. 15 indicates the clutch mechanism in an operating condition.

As best shown in FIGS. 14 and 15, a clutch follower unit 24 is a rod-like or thick board-like member fitted into a diametrically elongate hole 20*a* formed in the drive shaft 20. The rounded front end 24*a* of the clutch follower unit 24 is normally urged by a helical compression spring 25 so as to project from the deep hole 20*a* to the outside of the drive shaft 20 in a radial direction.

Figure 10:
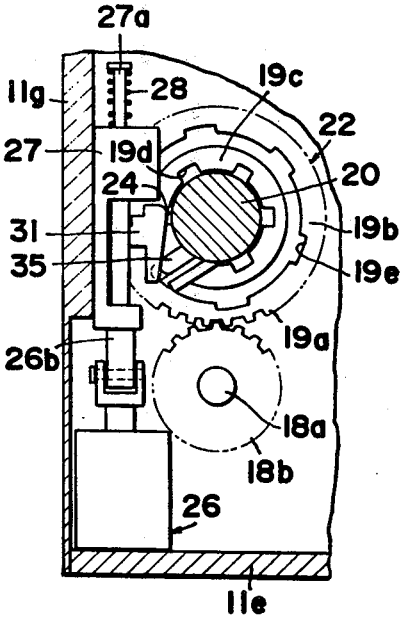
FIG. 10 is a sectional view on line 10—10 of FIG. 6.

Referring to FIGS. 6 and 10, an electromagnet 26 is mounted on the base plate 11*e* of the housing 11. An operation rod 26*b* extending upward through the coil 26*a* of the electromagnet 26 is shaped like a cylinder, the lower end portion of which has a larger diameter than the remaining portion. The operation rod 26*b* extends above the supporting member 27 through guide holes 27*a*, 27*b* formed in the upper and lower parts of a supporting member 27 fixed on the side wall 11*g* of the housing 11 and is normally urged upward by an extension spring 28 (FIGS. 14, 15). A manually operative lever 29 is pivoted, as shown in FIGS. 14 and 15, to the supporting member 27 by means of a pin 30 to be operated by an operator's finger put into the connecting device from the outside through a window 11*h* formed in the side wall 11*g* of the housing 11. The front end 29*a* of the manually operative lever 29 passes through the hole 26*c* of an operation rod 26*b* and normally abuts against the lower wall of the hole 26*c*. When the operation rod 26*b* is depressed, the front end 29*a* is brought downward, as shown in FIG. 15, by the upper wall of the hole 26*c*.

Referring to FIG. 14, a stop member 31 disposed between the driving shaft 20 and operation rod 26*b* has an arm 31*c* which extends into a depression or hole 26*d* formed in the operation rod 26*b* and is pivoted thereto by means of a pin 32. A push rod 34 is fitted into a cylindrical hole 27*c* formed in that part of the supporting member 27 which is positioned above the stop member 31. The push rod 34 normally depressed by a helical compression spring 33 normally has its lower end pressed against the flat upper surface of the stop member 31, thereby preventing the stop member 31 from being rotated counterclockwise in FIG. 14. A cam surface 31*a* presenting an arcuate form in a longitudinal section is provided on the upper plane of that side of the stop member 31 which faces the driving shaft 20. Normally, the front end 24*a* of the clutch follower unit 24 is pressed against the cam surface 31*a* to be prevented from projecting out of the diametrically elongate hole 20*a* formed in the driving shaft 20. The stop member 31 is further provided with another cam surface 31*b* facing the driving shaft 20 which is upward inclined toward the left side of FIG. 14. One end portion of a control lever 35 is pivoted to a depression 20*b* formed in the lower part of the driving shaft 20 by means of a pin 36.

The other rounded end 35*b* of the control lever 35 is pressed against the inner peripheral wall of the first engaging element 19*e* or the inner surface of the outer cylindrical portion 19*b* of the clutch driver unit 19. The driving shaft 20 is fitted with a spring seat 37 which is disposed below the control lever 35 and extends substantially in parallel therewith. The control lever 35 is urged clockwise by a helical compression spring 38 provided between the control lever 35 and spring seat 37. The cam surface 35*a* of the control lever 35 which is formed near the rounded end 35*b* thereof with a semicircular cross section abuts against the cam surface 31*b* of the stop member 31.

When electric power is not supplied to the coil 26*a* of the electromagnet 26, namely, while the coil 26*a* remains inoperative, the operation rod 26*b* is pushed upward by the helical extension spring 28, and the stop member 31 causes the clutch follower unit 24 to remain inserted into the diametrically elongate hole 20*a* of the drive shaft 20, thereby releasing the drive shaft 20 from the clutch driver unit 19. While, as shown in the arrangement of FIG. 14, the rounded end 35*b* of the control lever 35 is pressed against one of the first engaging elements 19*e* of the clutch driver unit 19, the clutch follower unit 24 is aligned with one of the second engaged elements 19*d* formed on the inner peripheral wall of the inner cylindrical portion 19*c* of the clutch driver unit 19. In this case, the stop member 31 causes the front end 24*a* of the clutch follower unit 24 to be brought right ahead of the corresponding second engaging element 19*d*. When the clutch driver unit 19 is rotated clockwise in FIG. 14, and the rounded end 35*b* of the control lever 35 rides on to the inner peripheral wall of the gear portion 19*a* of the clutch driver unit 19, the control lever 35 is rocked clockwise, causing its cam surface 35*a* to push the cam surface 31*b* of the stop member 31. As the result, the stop member 31 is rocked clockwise to force the clutch follower unit 24 into the diametrically elongate hole 20*a* of the driving shaft 20, thereby preventing the front end 24*a* from contacting the inner peripheral wall of the inner cylindrical portion 19*c* of the clutch driver unit 19. While, therefore, the coil 26*a* of the electromagnet 26 remains inoperative, the driving shaft 20 is not rotated, even when the clutch driver unit 19 is rotated.

When the coil 26*a* of the magnetic coil 26 is supplied with power to be put into operation, the operation rod 26*b* is pulled downward, causing the stop member 31 to fall and be released from the front end 24*a* of the clutch follower unit 24. Accordingly, the clutch follower unit 24 is pushed out of the diametrically elongate hole 20*a* of the drive shaft 20 by the compression spring 25 to engage the second engaging element 19*d* as shown in FIG. 15, thereby coupling the drive shaft 20 to the clutch driver unit 19. Thus the clutch driver unit 19 is rotated with the drive shaft 20. At this time, the cam surface 31*b* of the stop member 31 is brought downward, causing said stop member 31 to be rocked counterclockwise in FIG. 15. The cam surface 31*b* which is released from the first engaging element 19*e* is not rocked by the rotation of the clutch driver unit 19, thereby preventing the stop member 31 from being rocked. As the result, there does not occur the possibility that the rotation of the clutch driver unit 19 ceases to be transmitted to the drive shaft 20 due to the disengagement of the front end 24*a* of the clutch follower unit 24 resulting from the rocking of the stop member 31. When the driving shaft 20 is rotated through an angle of, for example, 120°, power supply to the coil 26*a* of the electromagnet 26 is stopped, causing the operation rod 26*b* to be pulled up to its original position (shown in FIG. 14) by the compression spring 28, and also the stop member 31 to be lifted. On the other hand, the driving shaft 20 continues to be rotated in the state coupled to the clutch driver unit 19 by the clutch follower unit 24. When the driving shaft 20 makes one nearly full rotation, the front end 24*a* of the clutch follower unit 24 projecting from the driving shaft 20 abuts against the cam surface 31*a* of the stop member 31 and not only causes the stop member 31 to be rotated counterclockwise up to the position indicated in FIG. 14, but also is itself inserted into the diametrically elongate hole 20*a* of the drive shaft 20 up to the point shown in FIG. 14, with the resultant disengagement of the driving shaft 20 from the clutch driver unit 19. Accordingly, the driving shaft 20 is returned to the position shown in FIG. 14 and brought to rest there.

The lever 29 is intended to be manually operated when the operation rod 26*b* is not brought back to the original position, for example, by a failure.

Figure 7:
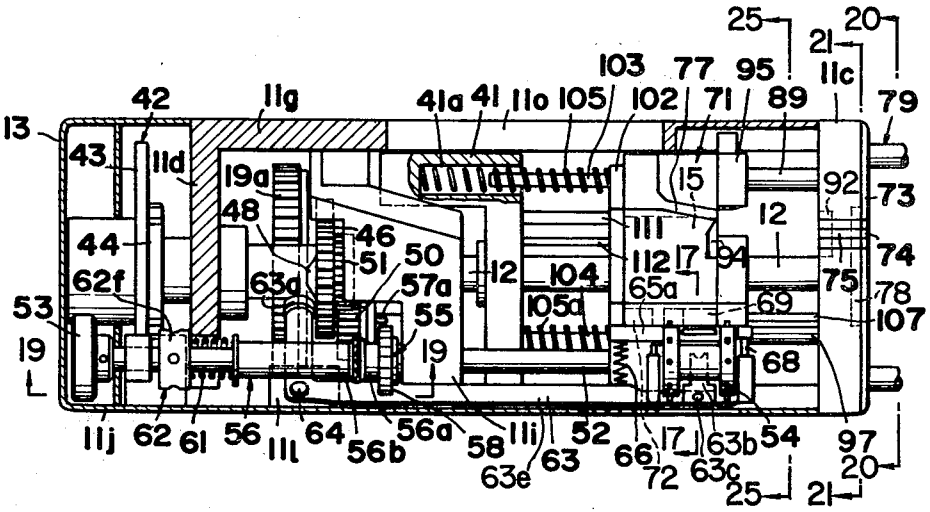
FIG. 7 is a plan view, partly in section, of a core wire-connecting device of FIG. 6 with the upper cover taken off.
Figure 11:
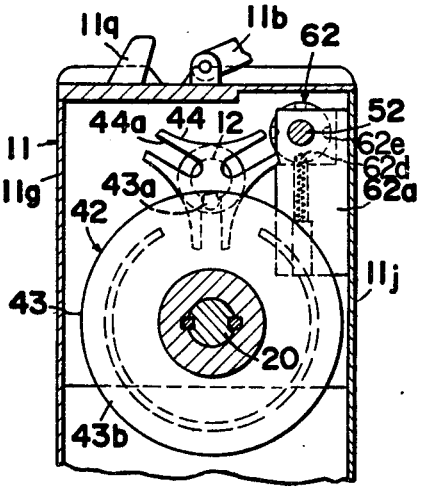
FIG. 11 is a sectional view on line 11—11 of FIG. 6.

Referring to FIG. 6, a cylindrical cam 39, the outer peripheral surface of which is provided with an endless groove 39*a*, is securely mounted on the drive shaft 20 to be rotated therewith. The cam groove 39*a* is provided with a roller 40, which is fixed to a driving member 41 supported on the main shaft 12 so as to allow the driving member 41 to reciprocate along the main shaft 12. When the driving shaft 20 makes one rotation, the driving member 41 makes one reciprocation cycle along the mainshaft 12. Referring to FIGS. 11, 6 and 7, the rotation of the driving shaft 20 is transmitted to the main shaft 12 by means of an intermittent rotation mechanism 42, which consists of a Geneva mechanism making a one-third rotation each time. A driving wheel 43 comprising a disc follower 43*b* and a pin 43*a* provided thereon is concentrically fixed to the driving shaft 20. A driven wheel 44 having three grooves 44*a* extending radially and arranged equidistantly in a circumferential direction is concentrically fixed to the main shaft 12. The pin 43*a* is not engaged with any of the three grooves 44*a*, until the driving shaft 20 makes a substantially 300° rotation, but is engaged with one of the three grooves 44a when the driving shaft 20 begins to be rotated through the remaining angle of about 60°, causing the main shaft 12 to be rotated together with the driven wheel 44.

Figure 8:
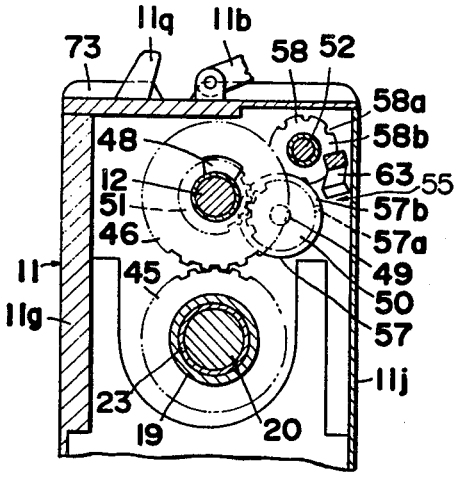
FIG. 8 is a sectional view on line 8—8 of FIG. 6.

The driving shaft 20 has a gear 45 provided, as shown in FIGS. 6 and 8, between the clutch driver unit 19 and cylindrical cam 39, the gear 45 being engaged with a gear 46 rotatably supported on the main shaft 12. These gears 45, 46 have a gear ratio of 1:1. A helical compression spring 47 is positioned between the inner wall 11*i* of the substantially central part of the housing 11 and gear 46 (FIG. 6). A sector-shaped cam 48, the circumferential cross section of which presents a trapezoidal form, is formed on that side of the gear 46 which is opposite to the inner wall 11*i* of the housing 11 (FIGS. 6 to 9). Referring to FIG. 8, a shaft 49 is cantilevered on the inner wall 11*i* of the housing 11 in parallel with the main shaft 12. A gear 50 fixed to the shaft 49 is engaged with a gear 51 integral with the gear 46. These gears 50, 51 have a gear ratio of 1:1.

Figure 19:
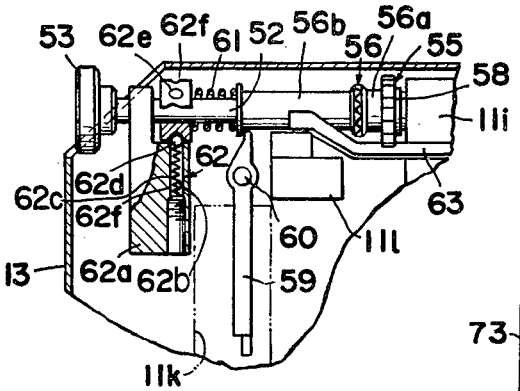
FIG. 19 is a sectional view on line 19—19 on FIG. 7.

Referring to FIGS. 7 and 19, a shaft 52 supported on the rear plate 13 and the inner wall 11*i* of the housing 11 extends in parallel with the main shaft 12. That end portion of the shaft 52 which extends outside of the rear plate 13 is fitted with a knob 53 for manual handling (FIG. 19). The opposite end of the shaft 52 is provided with sprocket wheels 54. Referring to FIGS. 7, 8, 19, the rotation of the driving shaft 20 is transmitted to the shaft 49 through the gears 45, 46, 51, 50 in turn. The rotation of the shaft 49 is transmitted to the shaft 52 through an intermittent rotation mechanism 55 and clutch 56 (FIG. 7). As best shown in FIG. 8, the intermittent rotation mechanism 55 consists of a Geneva mechanism. Namely, a driving wheel 57 formed of a disc 57*b* provided with a pin 57*a* is fixed to the shaft 49. A driven wheel 58 formed of a disc 58*b* provided with depressions or teeth 58*a* equidistantly arranged on the outer periphery is rotatably supported on the shaft 52 (FIGS. 8, 19). The pin 57*a* is engaged with one of the depressions 58*a* while the driving shaft 20 makes a rotation through an angle of about 240° as later described. Referring to FIG. 19, a clutchdriving element 56*a* integrally formed with the driven wheel 58 is engaged with a driven part 56*b* formed of a sleeve which is rotated with the shaft 52 and fitted thereinto so as to move in the axial direction of the shaft 52. The shaft 52 is rotated through an angle corresponding to the interval of the respective depressions 58*a*, each time the gear 50 makes one full rotation. The housing 11 is provided inside with a lever 59 (FIGS. 5, 19) for manual operation so as to be accessible through a window 11*k* formed in the lateral wall 11*j* of the housing 11. If necessary, the lever 59 is rocked about a pin 60 fixed to the lateral wall 11*j*, counterclockwise in FIG. 19, causing the driven part 56*b* to be moved leftward along the shaft 52 against the force of a helical compression spring 61, thereby disengaging the driving part 56*a* from the driven part 56*b* to rotate the shaft 52 manually by gripping the knob 53, for the adjustment of the rotating angle of the shaft 52. The shaft 52 is rotated by a positioning mechanism 62 each time exactly through a prescribed angle, namely, an angle defined by an interval between the respective depressions 58*a*. This positioning mechanism 62 comprises a helical compression spring 62*c* inserted into a vertical hole 62*b* formed in a supporting block 62*a* fixed to the lateral wall 11*j* of the housing 11; a ball 62*d* made to project above the hole 62*b* by the compression spring 62*c;* and a disc 62*f* secured to the shaft 52 and provided with depressions 62*e* arranged equidistantly in a circumferential direction on the outer periphery. The shaft 52 is prevented from overrun since the ball 62*d* is inserted into the depression 62*e* which is brought to such a position as faces the ball 62*d*.

Referring to FIG. 7, an L-shaped lever 63 is used as a connector-disengaging member. The bent portion of the L-shaped lever 63 is rotatably supported by a pivotal shaft 64 on a bracket 11*l* fixed to the lateral wall 11*j* of the housing 11. A roller 63*a* mounted on one end of the L-shaped connector-disengaging member 63 engages the sector-like cam 48. A helical compression spring 66 is disposed between that part of the connector-disengaging member 63 which extends in parallel with the shaft 52 and a guide plate 65*a* facing the sprockets 54. The compression spring 66 urges the connector-disengaging member 63 clockwise in FIG. 7, causing the roller 63*a* of the disengaging member 63 to be normally pressed against that plane of the gear 46 on which the cam 48 is formed. A connector-disengaging element 63*b* is connected to the other end of the connector-disengaging member 63 by means of a pin 63*c*. The shafts 49, 52, intermittent rotation mechanism 55, clutch 56, cam 48, connector-disengaging member 63, sprocket 54 and guide plates 65*a*, 65*b*, 65*c* collectively constitute a connector-feeding mechanism 67.

Referring to FIG. 17, the magazine 6 is inserted into the housing 11 by passing through the upper portion of an opening 11*m* formed in the lateral wall 11*j* of the housing 11 and along a guide member 65*c* provided at the upper portion of the opening 11*m*. While the magazine 6 is conducted through the housing 11, the perforations 10 of the magazine 6 are engaged with the pins 54*a* of the sprocket 54. Thereafter, the magazine 6 passes in turn along the guide plate 65*a* provided between the sprockets 54 and the lateral side of the later described movable housing 71, and the guide plate 65*b* extending from the guide plate 65*a* to the lower portion of the opening 11*m* and is taken out of the housing 11 from below the opening 11*m*. The guide plate 65*a* is bored with a hole 70 for allowing the passage of the connector 1, the hole 70 being aligned with the front end portion 63*f* of the connector-disengaging element 63*b*.

When the driving shaft 20 commences rotation, the front end portion 63*f* of the connector-disengaging element 63*b*, the hole 70 of the guide plate 65*a* and the front receptacle 69 of the rotor 15 are brought into alignment (FIGS. 17, 18). The sector-shaped cam 48 of the gear 46 has its outline so defined as to be disengaged from the roller 63*a* of the connector-disengaging member 63 while the driving shaft 20 makes a 60° rotation after commencing rotation. In FIGS. 7 and 18, a pair of guide rods 68 extend across the subject core wire-connecting device with the sprockets 54 disposed therebetween. The guide rods 68 are inserted into sleeves 63*d* provided at both ends of a bracket 63*g* fixed to the connector-disengaging element 63*b*, enabling the element 63*b* to reciprocate without crosswise shaking.

Referring to FIGS. 7, 17 and 18, as the rotation of the driving shaft 20 goes on, the roller 63*a* of the connector-disengaging member 63 is brought on to the cam 48, causing the connector-disengaging member 63 to rock about the pivotal shaft 64 counterclockwise in FIG. 7 against the force of the compression spring 66. As the result, the connector-disengaging element 63*b* advances toward the hole 70 to bring the front end portion 63*f* of the element 63*b* in front of the hole 70. At this time, the connector container 8 provided on the magazine 6 and facing the hole 70 is deformed under the pressure applied by the front end portion 63*f*, *allowing the connector 1 received in the container 8 to be forced through the hole 70 into the front receptacle 69 formed in the rotor 15 and facing the hole 70. The circumferential position of the later described movable housing 71 where the connector feeding mechanism furnishes the rotor 15 with the connector 1 is referred to as a* "first station". When the roller 63*a* of the connector-disengaging member 63 is disengaged from the cam 48 before the driving shaft 20 completes a 60° rotation, the connector-disengaging member 63 is rocked clockwise to regain its original position, and in consequence, the connector-disengaging element 63*b* is brought back to its original position. When the connector-disengaging element 63*b* is carried forward and yet the corresponding connector container 8 is not brought into alignment with the front end portion 63*f* of the connector-disengaging member 63, the front end portion 63*f* does not push the connector container 8, but that portion of the connector belt 7 which lies between the adjacent connector containers 8. Since, however, the gear 46 is provided with the sector-shaped cam 48 is elastically supported, as shown in FIG. 6, by the compression spring 47, the cam 48, together with the gear 46, is carried to the right hand on the main shaft 12 by the resilient force of the flexible connector belt 7. If, therefore, the abovementioned intervening portion of the flexible connector belt 7 between the adjacent connector containers 8 is pushed by the front end portion 63*f* of the connector-disengaging element 63*b*, the intervening portion is little likely to be broken. Occurrence of such undesirable event can be avoided by counterclockwise rocking the lever 59 shown in FIG. 19 to separate the driving and driven parts 56*a*, 56*b* from each other, manually operating the knob 53 to rotate the shaft 52 and aligning the corresponding connector container 8 with the front end portion 63*f* of the connector-disengaging element 63*b*.

Figure 9:
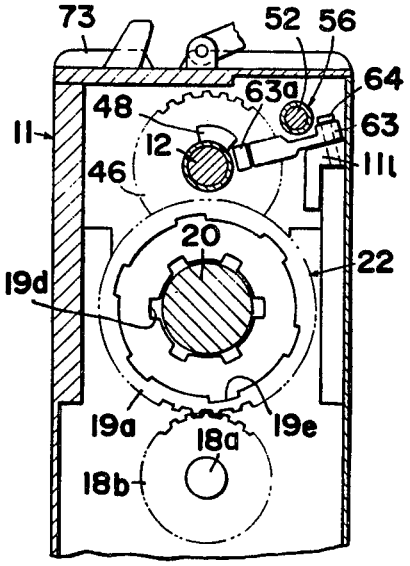
FIG. 9 is a sectional view on line 9—9 of FIG. 6.

Referring to FIGS. 8 and 9, while the driving shaft 20 makes a 60° rotation, the pin 57*a* of the gear 50 is not brought into engagement with the depression 58*a* of the driven wheel 58, thereby preventing the rotation of the shaft 52. When the driving shaft 20 is further rotated beyond 60°, the pin 57*a* of the gear 50 engages the depression 58*a* of the driven wheel 58, causing the wheel 58 to rotate through an angle corresponding to an interval between the adjacent depressions 58*a*. As the result, the sprockets 54 are rotated by means of the shaft 52 through an angle which is chosen to cause a connector container 8 following an emptied container to be aligned with the front end portion 63*f* of the connector-disengaging element 63*b*.

Figure 23:
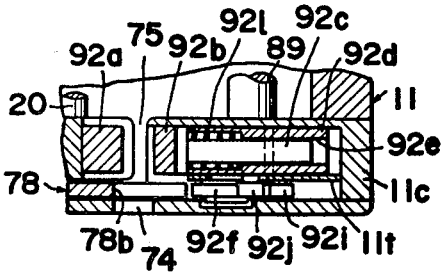
FIG. 23 is a sectional view on line 23—23 of FIG. 22.
Figure 24:
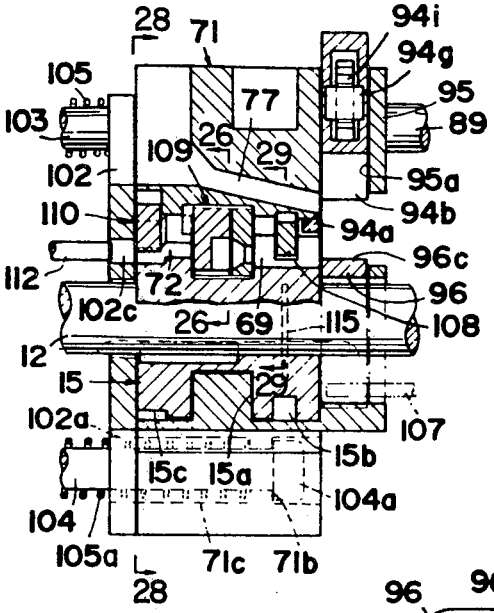
FIG. 24 is a sectional view on line 24—24 of FIG. 25.

Referring to FIG. 24, the outer periphery of the rotor 15 (FIG. 6) mounted on the main shaft 12 so as to be received in the movable housing 71 is provided with three grooved front receptacles 69 which extend in parallel with the main shaft 12 and are arranged equidistantly in a circumferential direction, namely, with a phase angle difference of 120° (FIG. 25), and also with three grooved back receptacles 72 which extend rearward of the front receptacles 69 in alignment therewith with the annular groove 15*a* at the substantial center of the rotor 15 interposed between both groups of receptacles (FIG. 23).

Figure 12:
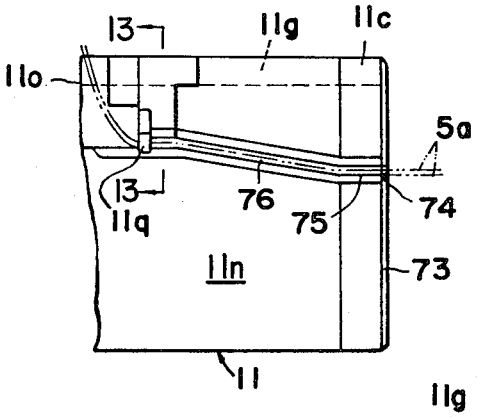
FIG. 12 is a fractional plan view of FIG. 5, showing the portion at which core wires are inserted into the core wire-connecting device.

Referring to FIGS. 5 and 12, both end portions of the front plate 11*c* of the housing 11 are covered with front covers 73 between which a generally vertical passage 74 is defined. Formed in the front plate 11*c* is another generally vertical passage 75 in alignment with the passage 74. The top plate 11*n* of the housing has a groove 76 which communicates with the vertical passages 74, 75 and extends to an opening 11*o* formed in the lateral wall 11*g* of the housing 11. The movable housing 71 is provided with a passage 77 communicating with the groove 76 (FIGS. 7, 24, 25, 26).

Figure 21:
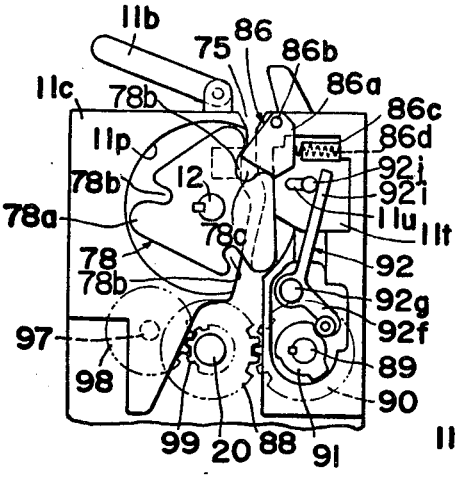
FIG. 21 is a sectional view on line 21—21 of FIG. 7.
Figure 22:
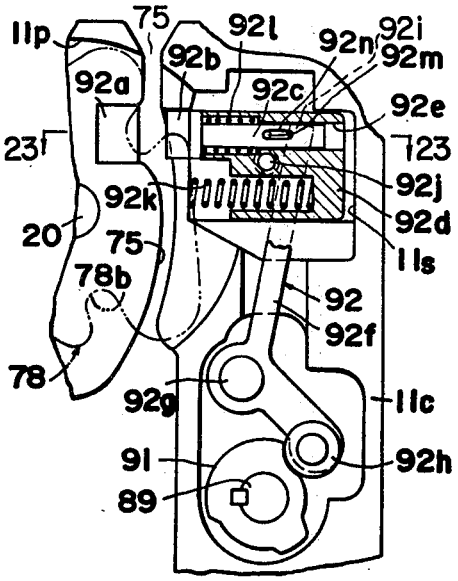
FIG. 22 is a fractional enlarged view of FIG. 21.

Referring to FIGS. 21 and 22, a circular opening 11*p* formed in the outer wall of the front plate 11*c* of the housing 11 receives a rotation unit 78. This rotation unit 78 comprises three depressions 78*b* which are formed on the peripheral edge of a generally triangular plate member 78*a* at the same phase angle as the front and rear receptacles 69, 72 and are equidistantly arranged in the circumferential direction.

Referring to FIG. 5, a pair of or a several number of joinable core wires 5 of a telecommunication cable are supported by the hands of the operator on a core-holding mechanism 79 positioned in front of the housing 11. This core-holding mechanism 79 comprises a pair of arms 80*a*, 81*a* projecting ahead of the front plate 11*c* of the housing 11; C-shaped holding members 80*b*, 81*b* extending upward from the ends of the arms 80*a*, 81*a*; core-restricting members 82, 83 rotatably fitted to the holding member 80*b* by means of pins 82*a*, 83*a*; and a holding member 84 formed of a leaf spring. When the core wires 5 are forced from above into an interspace between the holding members 80*b*, 81*b*, the holding member 84 is drawn near the holding member 80*b*, and the core-restricting member 82 is rotated downward against the force of the corresponding extension spring 82*b*, causing the core wires 5 to be held in a space 85 defined by the holding member 81*b*, holding member 84, and core-restricting members 82, 83.

When the joinable end portions 5*a* of, for example, two cores of a telecommunication cable are fully connected and pulled downward, the core-restricting member 83 is rotated downward against the force of the corresponding extension spring 83*b*, allowing the connecting core wires 5 to be removed from the space 85.

The core wires which are to be connected are fed to the subject core wire-connecting device through the undermentioned steps. For convenience, the following description relates to two core wires. The joinable end portions 5*a* of the two core wires 5, each belonging to the respective counterpart cables, which are held by the core-holding mechanism 79 are set in parallel by the hands of the operator. The two joinable end portions 5*a* of the two cores 5 are inserted into the housing 11 from above, after passing through the passages 74, 75, groove 76 and the opening 11*o* of the housing 11. Those parts of the joinable end portions 5*a* which protrude from the groove 76 at this time are bent, as shown in FIG. 12, toward the outside of the housing 11 within the opening 11*o*. After brought downward while kept in a horizontal position, the joinable end portions 5*a* are made to be inserted into one of the depressions 78*b* of the rotation unit 78 and the passage 77 of the movable housing 71.

Referring to FIGS. 21 and 22, a core-end restricting mechanism 86 is provided between the front plate 11*c* of the housing 11 and the front cover 73 to prevent the core wires 5 from being thrown upward. This core-end restricting mechanism 86 comprises a plate-like restriction element 86*a* disposed between the passages 74, 75 and rotatably pivoted to the outer wall of the front plate 11*c* of the housing 11 by means of a pin 86*b* and a helical compression spring 86*d* received in a cylindrical hole 86*c* formed in the front plate 11*c* so as to urge the restricting element 86*a* towards the plate member 78*a*. The joinable end portions 5*a* of the two core wires 5 are inserted into the depression 78*b* of the rotation unit 78 by rotating the restricting element 86*a* counterclockwise in FIG. 21 against the force of the compression spring 86*d*. After passage of the joinable end portions 5*a*, the restricting element 86*a* regains its original position by the force of the compression spring 86*d*, thereby defining, as shown in FIG. 21, a closed space 78*c* for holding the joinable end portions 5*a* in cooperation with the plate member 78*a*. Therefore, even when tending to float out of the depression 78*b* of the rotation unit 78 due to the original bending propensity of the core wires 5 or the forced bending thereof, the joinable end portions 5*a* are prevented from floating outward and are securely kept within the closed space 78*c*.

Figure 13:
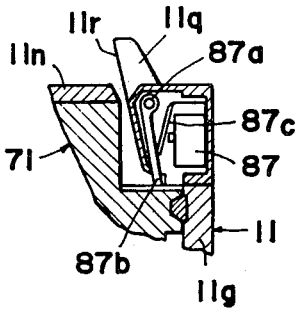
FIG. 13 is a sectional view on line 13—13 of FIG. 12.

Referring to FIG. 13, a wire-guiding element 11*q* projects above the top plate 11*n* of the housing 11 and faces the opening 11*o* thereof. The inner edge of the wire-guiding element 11*q* facing the groove 76 and the inner edge of the lateral wall 11*g* of the housing 11 which is positioned immediately below the wire-guiding element 11*q* jointly define a wire-guiding edge 11*r* for the joinable end portions 5*a*. The joinable end portions 5*a* brought downward along the wire-guiding edge 11*r* cause the lower end of a lever 87*b* to be rotated counterclockwise about a pin 87*a* against the force of a leaf spring 87*c*. The rotation of the lever 87*b* actuates a starting switch 87 received in a depression formed in the lateral wall 11*g* of the housing 11.

Referring to FIG. 14, actuation of the starting switch 87 causes power to be supplied to the coil 26*a* of the electromagnet 26. As the result, the clutch 22 transmits the rotation of the output shaft 18*a* to the driving shaft 20 for its full rotation. While the driving shaft 20 makes an initial 60° rotation, the joinable end portions 5*a* of the two cores 5 are cut off in the later described manner and a connector 1 is delivered to the front receptacle 69 which is positioned to face the hole 70 of the guide plate 65*a*, that is, at the first station. During this time, the rotor 15 is prevented from rotation.

Figure 20:
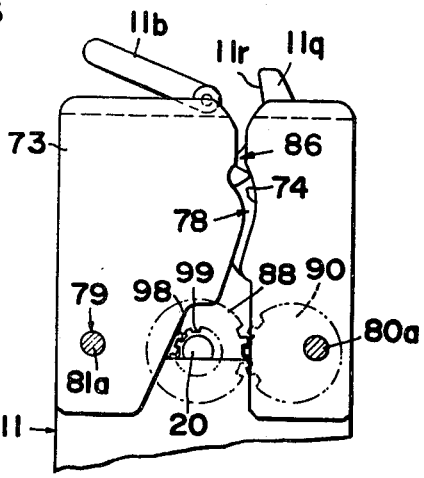
FIG. 20 is a front view on line 20—20 of FIG. 7.

Referring to FIGS. 20 and 21, a gear 88 (FIG. 6) fixed to the front end of the driving shaft 20 is engaged with a gear 90 fixed to a shaft 89 (FIG. 21) extending in parallel with the driving shaft 20 and supported by the front plate 11*c* and inner wall 11i of the housing 11. Both shafts 20, 89 are rotated at the same speed. A cam 91 mounted on the shaft 89 actuates, as later described, a core-holding unit 92 (FIG. 22), which comprises a fixed holding element 92*a* and a movable holding element 92*b* both of rubber-like elastic material which face each other across the vertical passage 75 formed in the front plate 11*c* of the housing 11 at that second station of the movable housing 71 which is circumferentially separated through 120° from the first station thereof in the rotation direction of the rotor 15 such that the forward extension of the front receptacle 69 at the second station passes between the elements 92*a* and 92*b*. Referring to FIGS. 22 and 23, the movable holding element 92*b* is fixed to the end of a round rod member 92*c* extending in the advancing direction of the movable holding element 92*b*. This rod member 92*c* is inserted into a guide hole 92*e* bored in a holding block 92*d* received in a depression 11s provided in the front plate 11*c* of the housing 11. The intermediate portion of a lever 92*f* is pivotally supported on the front plate 11*c* by means of a pin 92*q* fixed to the housing 11. A roller 92h provided on the lower end of said lever 92*f* is pressed against the periphery of the cam 91 mounted on the shaft 89. The upper end 92*i* of the lever 92*f* abuts against a pin 92*j* projecting from the holding block 92*d*. A helical compression spring 92*k* received in the depression 11*s* formed in the front plate 11*c* of the housing 11 urges the holding block 92*d* to the right in FIG. 22 so as to remove the movable holding element 92*b* from the fixed holding element 92*a* and also normally press the roller 92*h* to the periphery of the cam 91. When the shaft 89 is rotated by the rotation of the driving shaft 20, the roller 92*h* is brought on to the surface of the larger diameter periphery of the cam 91. As the result, the lever 92*f* is rotated about the pin 92*g* counterclockwise in FIGS. 21 and 22 to push the pin 92*j* to the left. The pin 92*j* is brought into a horizontal elongate hole 11*u* (FIG. 21) formed in a front plate 11*t* covering the depression 11*s* to shift the holding block 92*d* to the left against the force of the helical compression spring 92*k*. As the result, the rod member 92*c* is moved to the left against the force of a helical compression spring 92*l* disposed between the movable holding element 92*b* and holding block 92*d*, while being guided by a pin 92*m* fitted into an elongate hole 92*n* bored in the rod member 92*c*. The fixed holding element 92*a* and movable holding element 92*b* tightly clamp the joinable end portions 5*a* of the core wires 5 now placed in the depression 78*b* by being held by the core end restricting mechanism 86.

Figure 25:
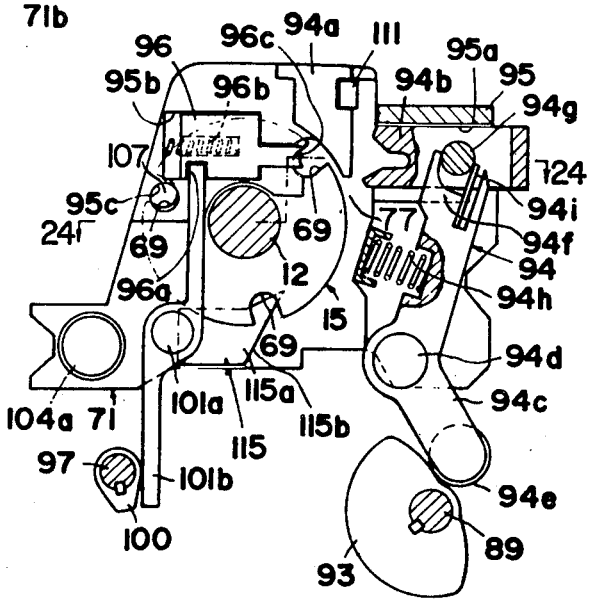
FIG. 25 is an enlarged front view of a rotor and movable housing.
Figure 26:
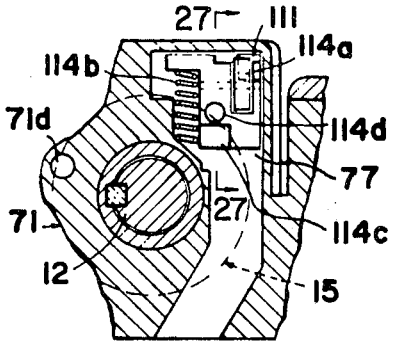
FIG. 26 is a sectional view on line 26—26 of FIG. 24.

Referring to FIG. 25, the shaft 89 is provided with another cam 93 for actuating a core cutting-off mechanism 94, which comprises a fixed cutter 94*a* and movable cutter 94*b* mounted on the front surface of the movable housing 71 in a mutually facing relationship across the passage 77. As shown in FIGS. 24 and 25, the fixed cutter 94*a* is disposed at an inlet to the passage 77 ahead of the front receptacle 69 of the rotor 15. The movable cutter 94*b* is received in a guide groove 95*a* formed in the front cover 95 of the movable housing 71. A lever 94*c* is rotatably supported on the front cover 95 by means of a pin 94*d*. A forked section 94*f* provided at the upper end of the lever 94*c* receives the pin 94*g* of the movable cutter 94*b*. A helical compression spring 94h disposed between the movable housing 71 and lever 94*c* actuates the lever 94*c*, such that when the movable housing 71 is pushed back, the movable cutter 94*b* is urged to be removed from the fixed cutter 94*a* and a roller 94*e* mounted on the lower end of the lever 94*c* is pressed against the periphery of the cam 93. The joinable end portions 5*a* of the core wires 5 are partly cut off at the same point by the following process. When the core-holding unit 92 is operated to set the joinable end portions 5*a* of the core wires 5 in place, the rotating cam 93 causes the lever 94*c* to be rotated about the pin 94*d* counterclockwise in FIG. 25 against the force of the compression spring 94*h*. As the result, the forked section 94*f* of the lever 94*c* pushes the pin 94*g* to the left by means of a leaf spring 94*i*. The movable cutter 94*b* is advanced to push the joinable end portions 5*a* of the cores 5 to the left until the blades of the cutters 94*a* and 94*b* overlap each other, thereby cutting off the joinable end portions 5*a* of the core wires 5 at the same point. Upon completion of the cutting, the movable cutter 94*b* is further moved to push leftward the joinable end portions 5*a* now cut off at the same point so as to be pressed against the arcuately depressed end 96*c* of a core stop 96 projecting ahead of the front receptacle 69. The cut-off unnecessary parts of the joinable end portions 5*a* of the core wires 5 are manually removed by the operator from the housing 11 through the passage 77 and opening 11*o*.

The core stop 96 is inserted into a guide groove 95*b* formed in the front cover 95 so as to slide horizontally therethrough, and is urged to the right in FIG. 25 by a helical compression spring 96*b* disposed between the core stop 96 and front cover 95. At least before the movable housing 71 commences advance after the cutting-off of the joinable end portions 5*a* (corresponding to the period in which the driving shaft 20 makes a first 60° rotation), the core stop 96 takes such a position that the arcuately depressed end 96*c* of the core stop 96 is aligned with the inner wall of the sleeve 2 provided in front receptacle 69 positioned at the back of the fixed cutter 94*a*, thereby enabling the joinable end portions 5*a* of the core wires to be reliably inserted into the sleeve 2 as later described. Formed in the underside of the core step 96 is an engaging groove 96*a* with which there is engaged the upper end of a lever 101*b* the center of which is pivotally supported by the front cover 95 and movable housing 71 by means of a pin 101*a*. Referring to FIGS. 20, 21, 6 and 7, a gear 98 mounted on a shaft 97 supported by the front plate 11*c* and inner wall 11i of the housing 11 and extending in parallel with the driving shaft 20 is engaged with a gear 99 fixed to the driving shaft 20. Referring again to FIG. 25, the lower end of the lever 101*b* is pressed against the periphery of a cam 100 mounted on the shaft 97 by means of the compression spring 96*b*. When the lever 101*b* is rocked counterclockwise in FIG. 25 about the pin 101a upon the rotation of the cam 100, the core stop 96 is carried to the left against the force of the compression spring 96*b*, causing the arcuately depressed end 96*c* of the core stop 96 to be shifted to a point at which the end 96*c* is prevented from being superposed in the front receptacle 69, thereby eliminating the possibility that when the movable housing 71 is carried forward, the insertion of the joinable end portions 5*a* of the core wires 5 is obstructed by the arcuately depressed end 96*c* of the core stop 96.

The process extending from the step of cutting off the joinable end portions 5*a* of the core wires 5 to the step of pressing the joinable end portion 5*a* against the arcuately depressed end 96*c* of the core step is effected during a first rotation of the driving shaft 20 through an angle of about 60°. During the following rotation of the driving shaft 20 through an angle of about 240°, two steps are carried out. In the first step, the conical wedge 3 is forced out of the sleeve 2 of the connector 1 received in the front receptacle 69 at the first station of the movable housing 71 into the rear receptacle 72 disposed behind the front receptacle 69. In the second step, the joinable end portions 5*a* of the core wires 5 received in the front receptacle 69 at the second station of the movable housing 71 are inserted into the sleeve 2, and thereafter the conical wedge 3 received in the rear receptacle 72 is forced into the sleeve 2 to connect the joinable end portions 5*a* of the core wires 5.

Figure 27:
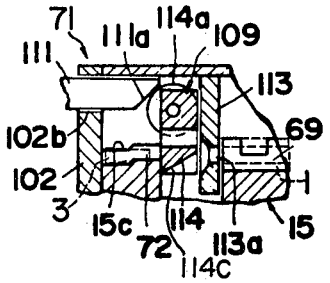
FIG. 27 is a sectional view on line 27—27 of FIG. 26.
Figure 28:
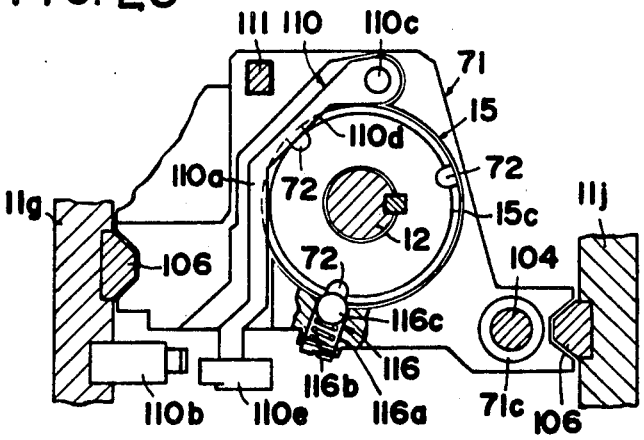
FIG. 28 is a sectional view on line 28—28 of FIG. 24.

There will now be described the operation of the movable housing 71 closely related to the above-mentioned two steps. Referring to FIGS. 6, 7, 24, when the driving shaft 20 commences a 240° rotation, the driving member 41 fitted in the cam groove 39a is moved along the main shaft 12 toward the front plate 11*c* of the housing 11. The free end of a first guiding rod 103 (FIGS. 7, 24) extending from the rear cover 102 of the movable housing 71 in parallel with the main shaft 12 reaches the long hole 41*a* of the driving member 41 (FIG. 7). A second guiding rod 104 extending from the driving member 41 in parallel with the main shaft 12 passes into the hole 71*c* of the movable housing 71 through the hole 102*a* of the rear cover 102 (FIG. 24). The head 104*a* of the free end of the second guiding rod 104 engages the stepped portion 71*b* of the hole 71*c* of the movable housing 71. Two helical compression springs 105, 105*a* wound about the two guiding rods 103, 104 respectively are provided between the rear cover 102 and driving member 41. As shown in FIG. 28, the movable housing 71 is supported on a pair of horizontal rails 106 laid in the housing 11, and can be moved along them by the driving member 41 with the aid of the compression springs 105, 105*a* up to a point at which the front cover 95 touches the front plate 11*c* of the housing 11. The wedge-removing member 107 projects rearward of the front plate 11*c* in parallel with the main shaft 12 in alignment with the front receptacle 69 at the first station of the movable housing 71 (FIGS. 7, 18, 24). A hole 95*c* is formed in the part of the front cover 95 which lies ahead of the front receptacle 69 positioned at the first station of the movable housing 71 and containing the connector 1 (FIGS. 18, 25). When the movable housing 71 is carried to extremely forward end, the wedge-removing member 107 passes through the hole 95*c* into the sleeve 2 of the connector 1, thereby forcing out the conical wedge 3 through the hole 71*d* (FIG. 26) of the movable housing 71 into the rear receptacle 72 lying behind the hole 71*d* (FIG. 27).

Figure 29:
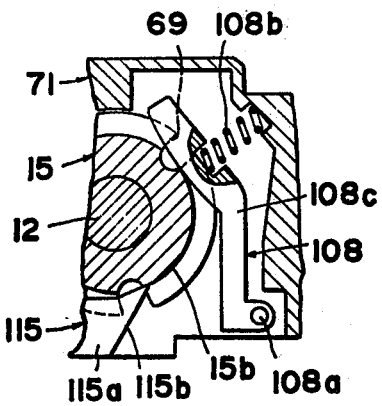
FIG. 29 is a sectional view on line 29—29 of FIG. 24.

The sleeve 2 and conical wedge 3 are received in a separated state attained by the above-mentioned operation in the corresponding ones of the front and rear receptacles 69, 72, which, at the second station of the movable housing 71, respectively occupy a phase position 120° shifted in the rotating direction of the rotor 15 from each point at which the conical wedge 3 is removed from the sleeve 2. The cutting of the joinable end portions 5*a* of the core wires 5 is carried out ahead of the front receptacle 69 set at the second station. The joinable end portions 5*a* cut off at the same point are placed in front of the front receptacle 69. As shown in FIG. 29, a sleeve-fixing unit 108 comprises an arm member 108*c* pivotally supported on the movable housing 71 by means of a pin 108*a* and a helical compression spring 108*b* disposed between the arm member 108*c* and movable housing 71 to urge the arm member 108*C* toward the rotor 15. The annular groove 15*b* dividing the front receptacles 69 into two front and rear groups is formed in the outer peripheral surface of the rotor 15. At the second station of the movable housing 71 the upper end of the arm member 108*c* is inserted into the annular groove 15*b* by the force of the compression spring 108*b*. Under this arrangement, the sleeve 2 is securely held in the front receptacle 69 by means of the arm 108*c* at the second station. When as later described, the rotor 15 is shifted from the first to the second station, the sleeve 2 pushes the arm member 108*c* for engagement therewith against the force of the compression spring 108*b*. Referring to FIG. 27, as the movable housing 71 is drawn nearer to the front plate 11*c* of the housing 11, the joinable end portions 5*a* of the core wires 5 cut off at the same point are further brought into the sleeve 2 and then carried through the die 113 of the core bending unit 109 received in the annular groove 15*a*. The die 113 will be later described in greater detail.

Referring to FIG. 28, the movable housing 71 is provided with a conical wedge-detecting unit 110 comprising a lever 110*a* and limit switch 110*b*. This detecting unit 110 is actuated when the conical wedge 3 is not received in the connector 1 and also when the wedge 3 is held in the sleeve 2 in a reversed position. The upper end of the lever 110*a* is supported on the movable housing 71 by means of a pin 110*c*. An arm portion 110*d* extending obliquely downward is fitted into a shallow annular groove 15*c* formed in the peripheral surface of the rear part of the rotor 15 so as to cross the rear half section of each rear receptacle 72. The lever 110*a* is made by its own weight to rotate in the direction in which it is fitted into the annular groove 15*c*. The lower end 110*e* of the lever 110*a* faces the limit switch 110*b* mounted on the inner wall of the housing 11. When the conical wedge 3 is placed in the sleeve 2 in the proper direction, the larger diameter section of the conical wedge 3 inserted into the rear receptacle 72 by means of the wedge-removing member 107 pushes up the arm portion 110*d* of the lever 110*a*. As the result, the lever 110*a* is rotated clockwise through a relatively large angle about the pin ll0*c*, causing the lower end 110*e* of the lever 110*a* to abut against the limit switch 110*b*. When the limit switch 110*b* is actuated by said abutment, the conical wedge 3 is detected to have a proper position in the rear receptacle 72. When the conical wedge 3 is not received in the rear receptacle 72 or when the wedge 3 is placed therein in a reversed position, the lever 110*a* is not moved or rotated to a relatively small extent. Accordingly, the lower end 110*a* of the lever 110*a* does not strike against the limit switch 110*b*, preventing it from being actuated. At this time, the power source of the subject core wire-connecting device is shut off or an alarm is given.

Referring to FIGS. 5, 6 and 7, when the front cover 95 of the movable housing 71 is pressed against the front plate 11*c* of the housing 11, the driving member 41 is drawn near the movable housing 71 against the force of the compression springs 105, 105*a*. The forward end of the driving member 41 is provided with that rod-like cam 111 for operating the core bending unit 109 which extends in parallel with the main shaft 12 and also with a wedge-inserting round rod member 112 for forcing the conical wedge 3 into the sleeve 2 during the first station of the movable housing 71 (FIG. 27).

Figure 30:
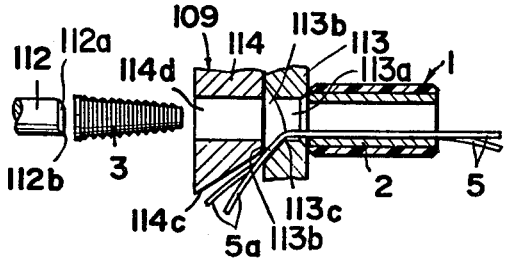
FIGS. 30 and 31 set forth the manner in which core wires are connected together.
Figure 31:
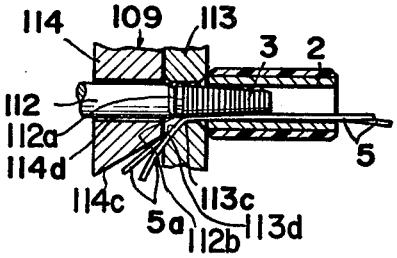
Figure 32:
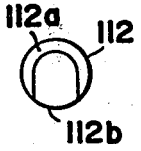
FIG. 32 is a front view of a wedge-inserting member.
Figure 33:
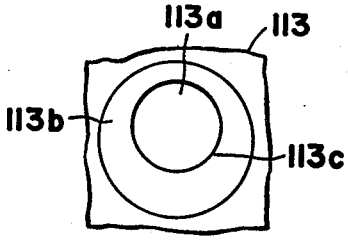
FIG. 33 is a fractional rear view of a die.

Referring to FIGS. 27, 30 and 33, the core-bending unit 109 comprises a die 113 bored with a hole 113*a* which is brought into alignment with the front receptacle 69 at the second station of the movable housing 71 and a bending member 114 disposed behind the die 113 to slide vertically along the bending member 114. The inclined end surface 111*a* of the cam 111 which has passed through a hole 102*b* of the rear cover 102 into the movable housing 71 abuts against a roller 114*a* rotatably supported on the upper end portion of the bending member 114, thereby bringing down the bending member 114 against the force of a helical compression spring 114*b* (FIG. 26) disposed between the movable housing 71 and bending member 114. Referring to FIGS. 27, 30 and 31, the underside of the bending member 114 is formed into a forwardrising inclined plane 114*c*. As the bending member 114 falls further downward, the joinable end portions 5*a* of the core wires 5 are pushed downward to be bent obliquely downward from a circular cutting edge 113*c* defined, as shown in FIG. 30, by the inner wall of the hole 113*a* of the die 113 and a conical surface 113*b* of the die 113 which has its center displaced from the center of the hole 113*a* toward the axis of the rotor 15 and has a maximum outer diameter larger than the diameter of the hole 113*a*. When a radial hole 114*d* formed in the bending member 114, hole 113*a* and sleeve 2 are all brought into alignment, those parts of the joinable end portions 5*a* of the core wires 5 which are bent downward from the circular cutting edge 113*c* are tightly clamped between planes 113*b*, 114*c*.

Upon completion of the above-mentioned process, the wedge-inserting member 112 is carried through a hole 102*c* of the rear cover 102 into the rear receptacle 72 now receiving the conical wedge 3 at the second station of the movable housing 71 (FIG. 24), thereby forcefully inserting the conical wedge 3 through the holes 114*d*, 113*a* into the sleeve 2 received in the front receptacle 69 at the second station of the movable housing 71 (FIG. 31). Referring to FIGS. 30 and 31, a chamfered portion 112*a* is formed on the greater part of the forward end face of the wedge-inserting member 112. The remaining lower part of the end face is provided with a cutting blade 112*b*. The circular cutting edge 113*c* and cutting blade 112*b* cooperate in cutting off those unnecessary parts of the joinable end portions 5*a* of the core wires 5 which extend behind the cutting blade 113*c*. The hole 113*a* and conical surface 113*b* of the die 113 are eccentrically arranged relative to each other as mentioned above. When, therefore, the wedge-inserting member 112 is set at a point at which the cutting blade 112*b* can cut off the unnecessary parts of the joinable end portions 5*a*, the upper side of the forward end of the wedge-inserting member 112 is restricted by the upper wall of the hole 113*a* of the die 113 and is prevented from escaping upward, thereby effecting the reliable cutting-off of the unnecessary parts of the joinable end portions 5*a* of the core wires 5. When the wedge-inserting member 112 forces the conical wedge 3 into the sleeve 2, those parts of the joinable end portions 5*a* now received in the hole 113*a* of the die 113 are slightly pushed backward together with the conical edge 3 to be fully inserted into the sleeve 2. At this point, the sharp annular ridges 3*a* formed on the peripheral surface of the conical wedge 3 break through the insulation layer of the joinable end portions 5*a* of the core wires 5 and bite into the underlying core wires 5, thereby firmly connect together the joinable end portions 5*a* electrically as well as physically.

When the conical wedge 3 is fully inserted into the sleeve 2, the driving member 41 commences retraction along the cam groove 39*a*, the wedge-inserting member 112 is pulled backward the holes 113*a*, 114*d* and rear receptacle 72. The cam 111 is disengaged from the roller 114*a* to be carried backward. The bending member 114 is brought back to its original position by the action of the compression spring 114*b*. When the driving member 41 commences retraction, the movable housing 71 remains pressed against the front plate 11*c* by the force of the compression springs 105, 105*a*. After, however, the head 104*a* of the second guiding rod 104 abuts against the stepped portion 71*b* of the hole 71*c*, the movable housing 71 is pulled backward by the driving member 41 away from the front plate 11*c* of the housing 11 to regain the original position. The core wires 5 which are securely set in place by the core-holding mechanism 79 are prevented from being drawn into the housing 11 while the movable housing 11 is carried backward. As the result, the connector 1 which has firmly connected the joinable end portions 5*a* of the core wires 5 is removed from the front receptacle 69 at the second station of the movable housing 71. Before return of the movable housing 71, the core cutting-off mechanism 94 is brought back to its original position. The core stop 96 is shifted to a point at which it is not superposed on the front receptacle 69.

While the driving shaft 20 makes the last rotation through an angle of about 60° the main shaft 12 is rotated 120°. As previously mentioned, the rotation of the driving shaft 20 is transmitted to the main shaft 12 by means of the intermittent rotation mechanism 42. The rotor 15 surrounded by the movable housing 71 is rotated clockwise in FIG. 25 together with the main shaft 12. The core-holding unit 92 is returned to its original position before said clockwise rotation. Referring to FIG. 25, before the rotation of the rotor 15, the connector 1 which has already connected the joinable end portions 5*a* of the core wires 5 and has been removed from the front receptacle 69 at the second station of the movable housing 71 is placed ahead of the front receptacle 69. The connected core wires 5 are received in the right upper depression 78*b* of the rotation unit 78 in FIG. 21, that is, the depression at the second station of the movable housing 71.

The plate member 78*a* of the rotation unit 78 is fixed to the main shaft 12, and, upon the 120° rotation of the rotor 15, is rotated 120° while holding the connected core wires 5 in the above-mentioned depression 78*b*, thereby causing the depression 78*b* at the second station to be turned downward. The connected core wires are carried downward through the passages 74, 75 and released from the depression 78*b*. When the connector 1 happens to be retained in the front receptacle 69 of the rotor 15 after the retraction of the movable housing 71, a connector take-out mechanism 115 is put into operation to remove the connector 1 from the front receptacle 69. Referring to FIG. 25, the connector take-out mechanism 115 is formed of a plate member 115*a* fixed to the movable housing 71 and having its edge inserted into the lower part of the annular groove 15*b*. When the connector 1 received in the front receptacle 69 at the second station of the movable housing 71 is moved together with the rotor 15 to a lower position which is separated 120° from the second station (this point is referred to as a "third station" of the movable housing 71), the connector 1 remaining in the front receptacle 69 is forcefully pushed out along an inclined surface 115*b* of the connector take-out mechanism 115.

Referring to FIG. 25, upon the rotation of the main shaft 12, the connector 1 which has been delivered to the front receptacle 69 at the first station of the movable housing 71 and in which the sleeve 2 and conical wedge 3 are separated from each other is carried to the front receptacle 69 at the second station. The front receptacle 69 which lies in the third station of the movable housing 71 and from which the connector 1 has been emptied is shifted to the first station. When the driving shaft 20 completes a 360° rotation, power supply to the coil 26*a* of the electromagnet 26 is cut. Therefore, the clutch mechanism 22 disengages the output shaft 18*a* from the driving shaft 20.

Referring to FIG. 7, the shaft 52 is rotated by means of the intermittent rotation mechanism 55 and clutch 56 at a proper point of time during the period in which the driving shaft 20 is being rotated through an angle of about 240°. This rotation is carried out, as previously mentioned, through an angle corresponding to an interval between the adjacent depressions 58*a* formed in the driven wheel 58. As the result, the sprocket 54 carries forward the magazine 6 to an extent corresponding to an interval between the adjacent connectors 1 arranged on the connector belt 7. When the connector-feeding mechanism 67 is operated, the connector 1 is delivered to the front receptacle 69 set at the first station of the movable housing 71.

Referring to FIG. 28, the movable housing 71 is provided with a rotor assembly-positioning mechanism 116 to define the position of the rotor 15, thereby causing the rotor 15 to be brought to rest when rotated accurately 120°. The rotor assembly-positioning mechanism 116 has such an arrangement that a helical compression spring 116*b* and a ball 116*c* urged toward the rotor 15 by the compression spring 116*b* are received in a hole 116*a* formed in the lower part of the movable housing 71, and the ball 116*c* projects from the hole 116*a* for engagement with the rear receptacle 72 at the third station of the movable housing 71. Even if the ball 116*c* is made to engage the front receptacle 69 at the third station, the object of properly positioning the rotor 15 can be attained all the same.

The operation of the subject core wire-connecting device may be summarized as follows. When a plurality of core wires constituting a telecommunication cable are inserted into the passages 74, 75, groove 76 and opening 11*o* all formed in the upper part of the housing 11 with the joinable end portions 5*a* set in parallel with each other, the joinable end portions 5*a* are inserted into the depression 78*b* of the rotation unit 78 and are securely held so as to be prevented from being displaced by means of the core endrestricting mechanism 86, causing the starting switch 87 to be actuated. As the result, the electric motor 16 and driving shaft 20 are coupled together by means of the clutch mechanism 22. While the driving shaft 20 makes a rotation through an angle of, for example, 60°, the core holding unit 92 is actuated securely to grip the core wires 5. The unnecessary parts of the joinable end portions 5*a* of the core wires 5 are cut off by the core cutting-off mechanism 94 at a point close to the lateral side of the rotor 15 and ahead of the front receptacle 69 at the second station. The joinable end portions 5*a* of the core wires 5 which are cut at the same point are placed in front of the front receptacle 69 at the second station. While the above-mentioned operation is continued, a connector 1 is delivered to the magazine 6 by means of the connector-feeding mechanism 67 to the front receptacle at the first station. While the driving shaft 20 is rotated further through an angle of, for example, 240°, the rotor 15 is moved toward the rotation unit 78. The conical wedge 3 of the connector 1 is separated from the sleeve 2 by the wedge-removing member 107 to be inserted into the rear receptacle 72 at the first station. The joinable end portions 5*a* of the core wires 5 are brought into the sleeve 2, and those parts of the joinable end portions 5*a* which extend out of the sleeve 2 are bent by the core-bending unit 109. The conical wedge 3 is forced into the sleeve 112 by the wedge-inserting member 112 as the rotor 15 is returned to its original position. While the above-mentioned operation is going on, the magazine 6 is carried forward, enabling the succeeding connector 1 to be delivered to the corresponding front receptacle 69 at the first station. While the driving shaft 20 is rotated for the last time through an angle of, for example, 60°, the main shaft 12 is rotated to turn the rotor 15 and rotation unit 78. As the result, the core wires 5 of a telecommunication cable connected by the connector 1 are taken out, and the connector 1 in which the conical wedge 3 and sleeve 2 were previously separated from each other is brought to a position where the coupling of both members is effected. When the driving shaft 20 completes one full rotation, the clutch 22 disengages the driving shaft 20 from the electric motor 16.

FIGS. 34 to 40 jointly set forth a modification of a core wire-connecting device according to this invention. This modification comprises a rotor 215 (FIGS. 35, 37) provided with grooved front receptacles 269 each for receiving a connector 1 and hollow cylindrical rear receptacles 272 each for receiving a conical wedge 3 removed from a sleeve 2; a rotation unit 278 (FIGS. 34, 36) for holding the joinable end portions 5*a* of a pair of or more core wires 5 constituting a telecommunication cable which are set in parallel and moving the joinable end portions 5*a* in the circumferential direction of the rotor 215; a wedge-removing member 307 (FIG. 39) for separating the conical wedge 3 from the sleeve 2; a core cutting-off mechanism 294 (FIG. 34) for cutting off the unnecessary parts of the joinable end portions 5*a* of the core wires 5; a wedge-inserting member 312 (FIGS. 34, 35) for forcing the conical wedge into the sleeve 2; a core-bending unit 309 (FIG. 34) for pulling the joinable end portions 5*a* of the core wires 5 toward one lateral wall of the sleeve 2 when the conical wedge 3 is brought into the sleeve 2; a connector-feeding mechanism 267 (FIG. 35) for carrying forward a magazine 6 to insert the connector 1 into the corresponding front receptacle 269; and a wedge-removing mechanism 317 (FIGS. 35, 39, 40) for actuating a wedge-removing member 307.

Figure 34:
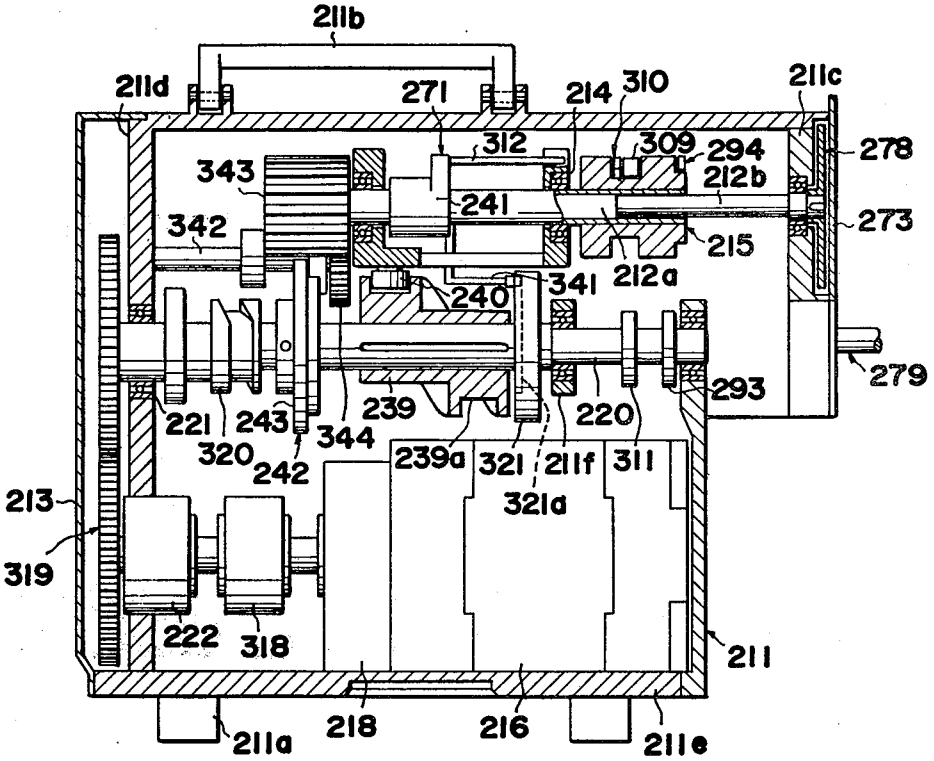
FIG. 34 is a lateral sectional view of another core wire-connecting device embodying this invention.
Figure 35:
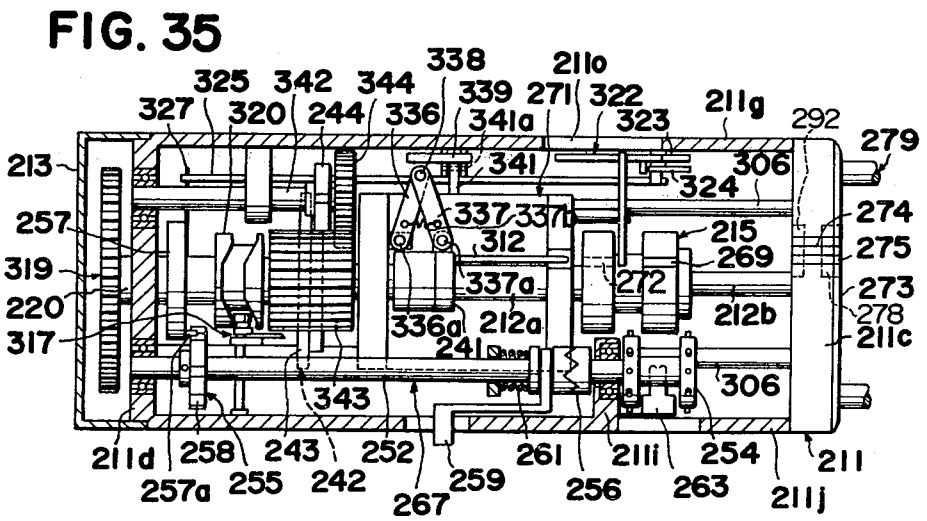
FIG. 35 is a plan view, partly in section, of the core wire-connecting device of FIG. 34 with the upper cover taken off.

Referring to FIGS. 34 and 35, the above-mentioned modified device is received in a fixed housing 211 provided with the same type of legs 211*a* and handle 211*b* as in the aforesaid core wire-connecting device. In the housing 211, one end of each of two round rod-like guide members 306 which are horizontally arranged in parallel with each other is supported on a front plate 211*c* and the other end thereof is supported on that part of an inner wall 211*d*, which is disposed near a rear plate 213 (FIG. 35). A movable housing 271 is carried along the rod-like guide members 306. A hollow shaft 212*a* extending in parallel with the guide members 306 is rotatably supported on the movable housing 271 by means of bearings 214. The rotor 215 is fixed to that end of the hollow shaft 212*a* which projects toward the front plate 211*c*. The rotation unit 278 surrounded by the front plate 211*c* is of the same type as the rotation unit 78 of the previously mentioned core wire-connecting device. The central shaft 212*b* of the rotation unit 278 is fitted into the hollow shaft 212*a* to rotate therewith (FIG. 34).

Mounted on the base plate 211*e* of the housing 211 is an electric motor 216, the rotation of which is transmitted to a driving shaft 220 extending in parallel with the hollow shaft 212*a* through a reduction unit 218, torque limiter 318, clutch mechanism 222, and gear train 319 in turn. The clutch mechanism 222 comprises a known one-revolution type clutch.

The driving shaft 220 is rotatably supported on the inner walls 211*d* and 211*f* of the housing 211 by means of bearings 221 (FIG. 34). The driving shaft 220 is provided with a driving wheel 257 (FIG. 35) included in the intermittent rotation unit 255 of a connector feeding mechanism 267; a cylindrical cam 320 (FIGS. 34, 35) for actuating the wedge-removing member 307 (FIG. 39); a cylindrical cam 239 (FIG. 34) for carrying forward the movable housing 271; a grooved cam 321 (FIG. 34) for operating a wedge-inserting member 312; a cam 311 (FIG. 34) for actuating the core bending unit 309 and a cam 293 (FIG. 34) for operating the core cutting-off mechanism 294.

The electric motor 216 continues rotation by means of a switch (not shown), until the prescribed core-connecting operation is put to an end.

A pair of or more core wires constituting a telecommunication cable which are to be connected together are placed by the hands of an operator in a core-holding mechanism 279 disposed in front of the housing 211. This core-holding mechanism 279 is of the same type as shown in FIG. 1. Two joinable end portions 5*a* selected from among the core wires 5 are set in parallel by the operator. The two joinable end portions 5*a* thus arranged are passed through vertically extending passages 274, 275 (FIGS. 35, 36) formed in the front plate 211*c* and front cover 273 and groove 276 (FIG. 36) formed in the top plate 11*n* of the housing 211 to be inserted into the housing 211 from above. At this time, the joinable end portions 5*a* of the core wires 5 extending rearward beyond the groove 276 are bent toward an opening 211*o* (FIG. 35) formed in the lateral wall 211*g* of the housing 211. When the joinable end portions 5*a* are brought downward, a starting mechanism 322 (FIG. 35) provided on the lateral wall 211*g* of the housing 211 is put into operation.

Figure 36:
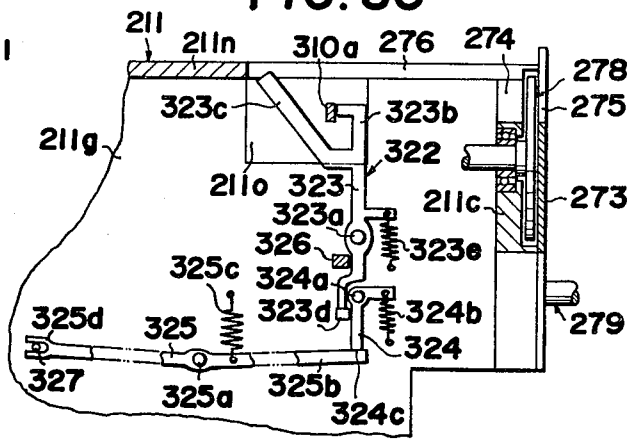
FIG. 36 illustrated a starting mechanism.

Referring to FIG. 36, the starting mechanism 322 comprises a first lever 323, second lever 324 and clutch lever 325 rotatably mounted on support shafts 323*a*, 324*a*, 325*a* respectively. The first lever 323 vertically extending along the lateral wall 211*g* of the housing 211 has its upper part provided with a reverse L-shaped arm 323*b* and another arm 323*c* which rises obliquely rearward up to the groove 276. The lower end of the first lever 323 is provided with a projection 323*d* engaging the second lever 324. The first lever 323 is further urged clockwise by a helical compression spring 323*e* and brought to rest in a state pressed against a stop 326. When the joinable end portions 5*a* of the core wires 5 are brought downward under the arrangement of FIG. 36, the portions 5*a* engages the arm 323*c* and rotates the arm 323*c* counterclockwise about the support shaft 323*a* against the force of the compression spring 323*e*. The second lever 324 is pushed to the right by the projection 323*d* to be rotated counterclockwise about the support shaft 324*a* against the force of a compression spring 324*b* urging the lever 324 clockwise, thereby causing a shoulder section 324*c* formed at the lower end of the second lever 324 to be released from the front end 325*b* of the clutch lever 325. The clutch lever 325 is rotated counterclockwise about the support shaft 325*a* by means of a compression spring 325*c*. As the result, a clutch-actuating arm 327 engaging a forked portion 325*d* formed at the rear end of the clutch lever 325 connectes together the driver unit and follower unit of the clutch mechanism 222 (FIGS. 34, 36).

When the unnecessary parts of the joinable end portions 5*a* of the core wires 5 are cut off by the core cutting-off mechanism 294 (FIG. 34), the first lever 323 now freed from the load of the core wires 5 is released, causing the first lever 323 and other levers 324, 325 to regain their original positions shown in FIG. 36 by being pulled back by the corresponding compression springs 323*e*, 324*b*, 325*c*.

The cut-off joinable end portions 5*a* of the core wires 5 are held by the rotation unit 278 and are set immovable by the same type of core-holding unit 292 as the core-holding unit 92 of the aforesaid core wire-connecting apparatus.

The driving shaft 220 makes one full rotation, that is through an angle of 360° by means of the clutch mechanism 222 (FIG. 34). While the driving shaft 220 is first rotated through an angle of, for example, 60°, the joinable end portions 5*a* are cut off in front of the front receptacle 269 at a second station corresponding to that of the first embodiment by the core cutting-off mechanism 294 while being supported by the core-holding unit 292. During said cutting, a connector 1 is delivered from the magazine 6 by a connector-feeding mechanism 267 to the front receptacle 269 at a first direction which is set apart 120° from the second station in a direction opposite to the rotation of the rotor 215. The core cutting-off mechanism 294 and cam 293 have the same construction and operative relationship as the core cutting-off mechanism 94 and cam 93 included in the previously described core wire-connecting device.

Referring to FIG. 35, the connector-feeding mechanism 267 is of the same type as the connector-feeding mechanism 67 included in the previously described core wire-connecting device and is provided with a pair of sprockets 254 engaging the magazine 6. A shaft 252 provided with the two sprockets 254 and extending in parallel with the driving shaft 220 is supported on the inner walls 211*d*, 211*i* of the housing 211.

A pin 257*a* projecting from the driving wheel 257 of the intermittent rotation mechanism 255 is engaged with one of the depressions or teeth arranged equidistantly in a circumferential direction on the peripheral surface of a driven wheel 258 mounted on the shaft 252, thereby causing the paired sprockets 254 to be rotated through a prescribed angle. A connector-disengaging member 263 is operated in the same manner as the connector-disengaging member 63 of the previously described core wire-connecting device to deliver the connector 1 received in the magazine 6 to any of the front receptacles 269 of the rotor 215.

Figure 39:
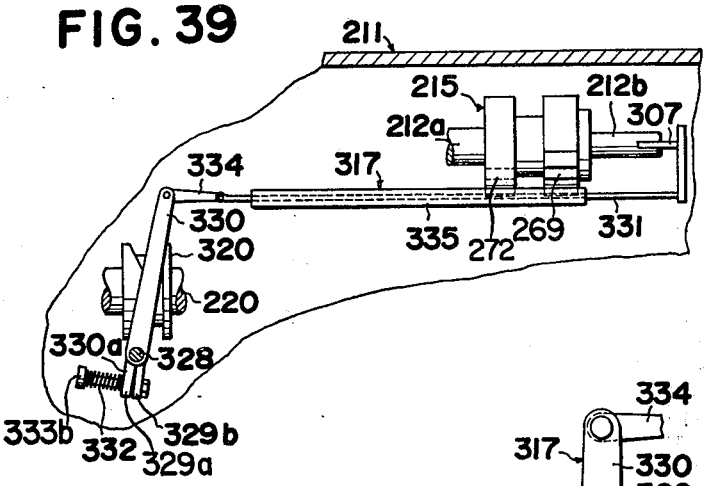
FIG. 39 is a front view of a connector-releasing mechanism.
Figure 40:
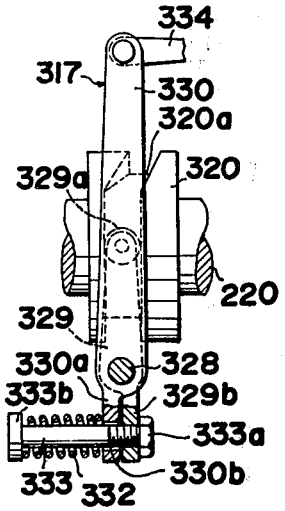
FIG. 40 is a fractional enlarged view of FIG. 39.

The front receptacles 269 are arranged on the peripheral surface of the rotor 215 in a state spaced from each other through a phase angle of 120°. Referring to FIGS. 35, 39 and 40, the wedge-removing mechanism 317 comprises first and second levers 329, 330 (FIG. 40) rotatably mounted on a pivotal shaft 328 projectively provided on the lateral wall 211*g* of the housing 211; a connection rod 331 (FIG. 39) coupling the second lever 330 to the wedge-removing member 307; and a helical compression spring 332 for urging the two levers 329, 330 jointly counterclockwise in FIGS. 39 and 40. A roller 329*a* mounted on the free or upper end of the first lever 329 is fitted into an annular cam groove 320*a* formed in a cylindrical cam 320 mounted on the shaft 220. A male screw portion formed at one end of a guide rod 333 is screwed into an arm 329*b* provided on the lower end of the lever 329 and is tightened by means of a nut 333*a*. The guide rod 333 loosely passes through a horizontal hole 330*b* bored in an arm 330*a* formed at the lower end of the second lever 330 normally substantially in parallel with the arm 329*b*. The compression spring 332 is of a helical coil type and surrounds the guide rod 333 between a head 333*b* disposed at the other end of the guide rod 333 and the arm 330*a*. The upper end of the second lever 330 and the connection rod 331 are coupled together by a link 334. The connection rod 331 passes through a guide tube 335 set immovable relative to the housing 211 so as to be linearly carried therethrough (FIG. 39).

The connector 1 delivered to the front receptacle 269 is kept immovable by the same type (not shown) as the sleeve-fixing unit 108 of the previously mentioned core wire-connecting device.

When the cam 320 rotates the first lever 329 counterclockwise in FIGS. 39 and 40 about the shaft 328 upon the rotation of the driving shaft 220, the second lever 330 is rotated counterclockwise as is the first lever 329, because the arms 329*b*, 330*a* are pressed against each other by means of the compression spring 332, causing the connection rod 331, together with the wedge-removing member 307, to be moved to the left in FIG. 39. As the result, the wedge-removing member 307 pushes the conical wedge 3 out of the sleeve 2 to the corresponding rear receptacle 272 at the second station (FIG. 39). If the conical wedge 3 is placed reversely in the sleeve 2, the conical wedge 3 is forced out of the sleeve 2 by being pushed at the larger diameter end, applying undue resistance to the wedge-removing member 307. The force of said resistance is transmitted to the second lever 330 through the connection rod 331 and link 334 in turn. As the result, the arm 330*a* is removed from the arm 329*b* of the first lever 329 against the force of the compression spring 332. Even when the first lever 329 is rotated by the cam 320, the second lever 330 is not rotated counterclockwise due to the resistance of the conical wedge 3, and its removal from the sleeve 2 is not carried out. Namely, the conical wedge 3 is taken out of the sleeve 2 only when properly directed therein.

Figure 37:
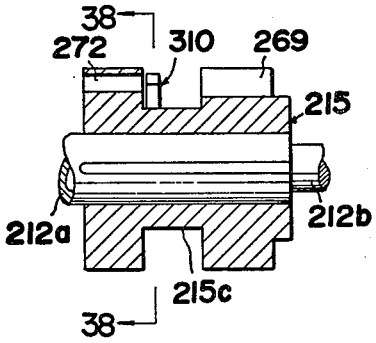
FIG. 37 is a longitudinal sectional view of a rotor.
Figure 38:
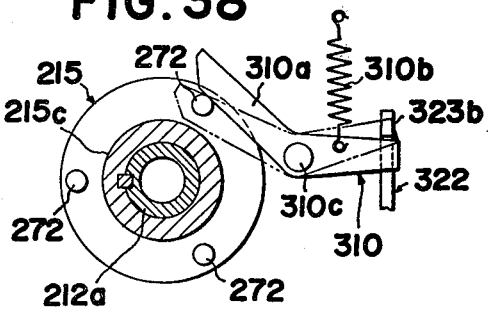
FIG. 38 is a sectional view on line 38—38 of FIG. 37.

Referring to FIGS. 34, 37 and 38, a detecting unit 310 for the conical wedge 3 is provided in an annular groove 215*c* formed in the outer periphery of the rotor 215 between the front and rear receptacles 269, 272 so as to be disposed in front of the corresponding rear receptacle 272. As seen from FIG. 38, this wedge-detecting unit 310 comprises a lever 310*a* and a helical compression spring 310*b*, and is actuated in the case of an unacceptable connector 1 which lacks a conical wedge 3 or in which the conical wedge 3 is received in the sleeve 2 in a reversed position as viewed from FIG. 1 and can not be taken out by the wedge-removing mechanism 317. The lever 310*a* is pivotally supported on the movable housing 271 by means of a pin 310*c*, and urged counterclockwise in FIG. 38 by means of the compression spring 310*b* anchored to the movable housing 271 to be fitted into the annular groove 215*c* formed at the center of the rotor 215 as shown in a dot-dash line in FIG. 38. When the conical wedge 3 is inserted into the corresponding rear receptacle and then the rotor 215 is rotated clockwise in FIG. 38, causing the sleeve 2 and conical wedge 3 to be brought to a point where the core wires 5 are to be connected, that is, at the second station, the lever 310*a* is rotated clockwise by that portion of the wedge 3 which projects into the groove 215*c* from the rear receptacle 272 now receiving the conical wedge 3 against the force of the compression spring 310*b*, thereby assuming a solid line position illustrated in FIG. 38. Where the connector 1 does not contain the conical wedge 3, the lever 310*a* remains urged counterclockwise as indicated in a dot-dash line in FIG. 38 by the urging force of the compression spring 310*b*. The right end (FIG. 38) of the lever 310*a* is brought into alignment with the projection 323*b* formed on the first lever 323 of the starting mechanism 322 (FIGS. 36, 38). When, under this arrangement, the joinable end portions 5*a* of the core wires 5 are going to be brought downward into the housing 211, the first lever 323 is prevented from rotation due to the projection 323*b* abutting against the lever 310*a* as shown in FIG. 36. As the result, the second lever 324 and clutch lever 325 are not put into operation, preventing the driving unit and follower unit of the clutch mechanism 222 from being coupled together. The joinable end portions 5*a* of the core wires 5 are brought down into the housing 211 only when the connector 1 is separated into the sleeve 2 and conical wedge 3 which in turn are received in the front receptacle 269 and rear receptacle 272 respectively, thus actuating the starting mechanism 322, since the lever 310*a* is disengaged from the projection 323*b* of the first lever 323.

Referring to FIGS. 34 and 35, when the unnecessary parts of the joinable end portions 5*a* of the core wires 5 are cut off by the core cutting-off mechanism 294, and the driving shaft 220 is further rotated, a roller 240 fitted into an endless groove 239*a* formed in the outer peripheral surface of a cylindrical cam 239 is moved in the forward axial direction of the driving shaft 220. Therefore, the movable housing 271 to which the roller 240 is fitted is carried to the right in FIGS. 34 and 35 along the guide rod 306. The rotor 215 mounted on the hollow shaft 212*a* supported on the movable housing 271 is also advanced to the right, causing the joinable end portions 5*a* of the core wires 5 to be inserted into the sleeve 2 held in the front receptacle 269 at the second station. The forward parts of the joinable end portions 5*a* of the core wires 5 which have passed through the sleeve 2 are bent by the core-bending unit 309. This core-bending unit 309 has the same arrangement and function as the core-bending unit 109 previously described by reference to FIGS. 26 and 27. A driving member 241, to which the rear end of the wedge-inserting member 312 is fixed, is mounted on the hollow shaft 212*a* so as to move in the axial direction thereof.

Referring to FIG. 35, a pair of links 336, 337 are pivoted at one end thereof to the movable housing 271 and driving member 241 by means of pins 336*a*, 337*a* respectively. The two links 336, 337 are joined together at the other end thereof by means of a pin 338. An actuating lever 339 is provided adjacent to the junction of the links 336, 337. The actuating lever 339 (FIG. 35) is provided with an arm 341 (FIGS. 34, 35) engaging the groove 321*a* of an end cam 321 (FIG. 34) mounted on the driving shaft 220. The arm 341 is rotatably supported on the housing 211 by means of a support shaft 341*a* (FIG. 35). When the arm 341 is rotated by the rotation of the cam 321 and the lever 339 pushes the junction of the links 336, 337, the links 336, 337 set in a folded state as illustrated in FIG. 35 are rotated to be separated from each other, causing the driving member 241 to be carried to the right relative to the movable housing 271 along the hollow shaft 212*a*. As the result, the wedge-inserting member 312 is brought into the corresponding rear receptacle 272, causing the conical wedge 3 in the rear recetpacle 272 to be forced into the sleeve 2. The wedge-inserting member 312 is preferred to be of the same type as the wedge-inserting member 112 of the previously mentioned core wire-connecting device. When the joinable end portions 5*a* of the core wires 5 are connected together in the connector 1 upon the full insertion of the conical wedge 3 into the sleeve 2, the lever 339 is brought back to its original position by means of the end cam 321 and the links 336, 337 and driving member 241 regain their original positions shown in FIG. 35 by the urging force of the compression spring 337*b*.

When the foregoing operation is brought to an end, the movable housing 271 and rotor 215 are moved to the left to return to their original positions by the rotation of the cylindrical cam 239. During this time, the core wires 5 are preventing from being carried forward since they are held by the rotation unit 278. The connector 1 which has firmly connected the joinable end portions 5*a* of the core wires 5 is pulled out of the corresponding front receptacle 269.

Referring to FIGS. 34 and 35, while the driving shaft 220 is rotated for the last time through an angle of 60°, that is, an angle lying between 300° and 360°, the hollow shaft 212*a* and central shaft 212*b* make a 120° rotation. The rotation of the driving shaft 220 is transmitted to the hollow shaft 212*a* by an intermittent rotation mechanism 242. The intermittent rotation mechanism 242 is of the Geneva type as is the intermittent rotation mechanism 42 of the previously mentioned embodiment. A driving wheel 243 is mounted on the driving shaft 220, and a driven wheel 244 is fixed to an intermediate shaft 342. The intermediate shaft 342 parallel with the driving shaft 220 is supported on the housing 211 and comprises a gear 344 engaging a sliding gear 343 provided at the end of the hollow shaft 212*a*. The two gears 343, 344 have the same number of teeth and are always engaged with each other.

While the driving shaft 220 is rotated for the last time, the driving wheel 243 is brought into engagement with the driven wheel 244, causing the hollow shaft 212*a* and central shaft 212*b* to be rotated. The rotation of the shafts 212*a*, 212*b* leads to the rotation of the rotation unit 278 (FIGS. 34, 36), enabling the connected core wires 5 to be taken out of the housing 211 at a third station 120° spaced from first and second stations in the circumferential direction. Here, the first, second and third stations correspond to those of the embodiment set forth in FIGS. 6 to 33. The sleeve 2 and conical wedge 3 separated from each other at the first station of the movable housing 271 are brought to the second station thereof. Namely, the rotor 215 is rotated through 120°. When the driving shaft 220 makes one full rotation, the clutch mechanism 222 disengages the driving shaft 220 from the electric motor 216.

Referring to FIG. 35, the shaft 252 of the connector-feeding mechanism 267 has a clutch 256 formed at the right end and is normally designed to cause the sprockets 254 to be rotated according to the rotation of the driving shaft 220 by means of a compression spring 261. When, however, a manually operative lever 259 is moved leftward against the force of a compression spring 261, the clutch 256 is rendered inoperative. This manually operative lever 259 is provided against the occurrence of an accident, for example, when the magazine 6 fails to be satisfactorily engaged with the sprockets 254.

We claim

1. A core wire-connecting device which comprises a driving shaft and a main shaft rotatably received in a fixed housing in parallel relationship with each other; a movable housing reciprocatively mounted on the main shaft; a rotor reciprocating therewith and capable of rotating with the main shaft; a plurality of connector receptacle means formed in the periphery of the rotor equidistantly spaced in a circumferential direction for receiving connectors, each formed of a sleeve and a conical wedge received therein; intermittent rotation means provided between said main shaft and driving shaft for intermittently rotating the main shaft, together with the rotor through an angle defined by the respective adjacent receptacle means with the main shaft, each time the driving shaft is rotated through a prescribed angle; reciprocating means for moving the rotor back and forth along the main shaft when the main shaft is not rotated by the intermittent rotation means and for bringing core wires into the sleeve; connector-feeding mechanism for delivering connectors one by one from a belt-like magazine on which the connectors are arranged equidistantly lengthwise in parallel with each other to any of the receptacle means when said any of the receptacle means is brought to a first station of said movable housing; conical wedge-removing means disposed at one end of the rotor in alignment with the receptacle means at said first station for pushing the conical wedge out of the sleeve of the connector received in said receptacle means to the other end of the rotor; a core cutting-off mechanism mounted on the movable housing in alignment with the receptacle means disposed near said one end of the rotor at a second station of said movable housing which is circumferentially separated from said first station through an angle corresponding to an angle defined by the adjacent front receptacles with the axis of said rotor for cutting off the unnecessary parts of the joinable end portions of the core wires, thereby allowing the tips of the cut-off ends of the core wires to be brought into alignment; conical wedge-inserting means provided at the other end of the rotor in alignment with the receptacle means at said second station for inserting the conical wedge into the sleeve; driving means for carrying the conical wedge-inserting means toward said one end of the rotor to an extent corresponding to the distance through which the conical wedge-inserting means pushes the conical wedge now released from the sleeve received in the receptacle means at said second station; and core-holding means for immovably supporting the core wires lengthwise of the main shaft.

2. A core wire-connecting device according to claim 1, wherein a narrow annular groove is formed at the substantially central part of the rotor; and the receptacle means comprises a plurality of front grooved receptacles extending from said narrow annular groove to said one end of the rotor to receive the sleeve of the connector and the same number of rear receptacles in the form of at least one of grooves and hollow cylinders and extending from said narrow annular groove to the other end of the rotor to receive the conical wedge released from the sleeve.

3. A core wire-connecting device according to claim 2, wherein said movable housing contains a sleeve-fixing unit for securely holding the sleeve of the connector received in the receptacle at said second station of the movable housing.

4. A core wire-connecting device according to claim 3, wherein said sleeve-fixing unit comprises a lever which is pivotally supported on the movable housing and one end of which can be inserted into the annular groove formed in the periphery of the rotor across the receptacles receiving the sleeve and biasing means for normally forcing said one end of the lever into said annular groove.

5. A core wire-connecting device according to claim 4, wherein a connector takeout mechanism formed of a plate member having a plane inclined in the rotating direction of the rotor is fitted into the annular groove of the rotor.

6. A core wire-connecting device according to claim 2, wherein a grooved engagement section is formed in the periphery of the rotor so as to cross that part of the receptacle where the conical wedge released from the sleeve is positioned, and there is also provided a conical wedge-detecting unit which is partly inserted into said grooved engagement section when the receptacles are brought between the first and second stations of the movable housing.

7. A core wire-connecting device according to claim 6, wherein said conical wedge-detecting unit comprises a lever pivotally supported in the movable housing to be brought into the grooved engagement section; urging means for moving the lever into the grooved engagement section; and device-stopping means for preventing the core wire-connecting device from carrying out the succeeding cycle of connecting core wires in cooperation with the lever when the conical wedge is not received in the rear receptacle or when the conical wedge is placed therein in a reversed position.

8. A core wire-connecting device according to claim 7, wherein said urging means comprises a weight member provided at one end of said lever.

9. A core wire-connecting device according to claim 7, wherein said urging means comprises a compression spring.

10. A core wire-connecting device according to claim 6, wherein said engagement section comprises said narrow annular groove.

11. A core wire-connecting device according to claim 2, further comprising a positioning mechanism engageable with the rear receptacle at a third station of the movable housing to rotate the rotor such that the receptacles are brought to rest exactly at the first and second stations.

12. A core wire-connecting device according to claim 11, wherein said positioning mechanism comprises a ball engageable with the rear receptacles at said third station and a compression spring for urging said ball into the rear receptacle.

13. A core wire-connecting device according to claim 2, wherein a core-bending mechanism is provided in said narrow annular groove to displace in the radial direction of the sleeve the joinable end portions of the core wires which project into said narrow annular groove from the front receptacle at the second station of the movable housing after penetrating the sleeve received in said front receptacle at the second station.

14. A core wire-connecting device according to claim 13, wherein said wedge-inserting means is provided with driving means for forcing said wedge-inserting means into the corresponding rear receptacle when the rotor, together with the movable housing, has been fully moved to the wedge-removing member.

15. A core wire-connecting device according to claim 14, wherein said reciprocating means comprises a cylindrical cam securely mounted on the driving shaft and having a substantially helical endless groove formed in the periphery thereof and a roller rotatably mounted on the movable housing to engage said endless groove.

16. A core wire-connecting device according to claim 15, wherein said driving means of the wedge-inserting means comprises a driving member provided with said roller and wedge-inserting means, provided at said other end of the rotor and elastically connected to the movable housing by means of a compression spring disposed between the movable housing and driving means.

17. A core wire-connecting device according to claim 16, wherein said wedge-inserting means comprises a rod type wedge-inserting member.

18. A core wire-connecting device according to claim 14, wherein said driving means of the wedge-inserting means comprises a driving member provided with the wedge-inserting means and lengthwise slidable over the main shaft; a pair of links urged toward each other to be folded together and pivoted to the wedge-inserting means and movable housing respectively at one end thereof and coupled together by a common pivot at the other end; an end cam securely mounted on the driving shaft; and link means pivoted to the fixed housing and having one end engaged with a groove formed in the end cam so as to allow the other end of the link means to press the pivoted other ends of the levers to open the levers as the end cam rotates.

19. A core wire-connecting device according to claim 18, wherein said wedge-inserting means comprises a rod type wedge-inserting member.

20. A core wire-connecting device according to claim 14, wherein a core-bending mechanism operated by the driving means of the wedge-inserting means is provided in said narrow annular groove to displace in the radial direction of the sleeve the joinable end portions of the core wires which project into said narrow annular groove after penetrating the sleeve received in the front receptacle at said second station of the movable housing and bend said joinable end portions likewise radially.

21. A core wire-connecting device according to claim 20, wherein said core-bending mechanism comprises a core-bending member reciprocative in the radial direction of the rotor; a roller provided at the opposite end of the core-bending member to that end thereof to which the joinable end portions of the core wires are displaced; and a cam fixed to the driving means of the wedge-inserting means to reciprocate said core-bending member in accordance with the reciprocation of the driving means.

22. A core wire-connecting device according to claim 21, further comprising core cutting-off mechanism for cutting off the unnecessary parts of the joinable end portions of the core wires which extend out of the sleeve after pulled in the radial direction of the sleeve.

23. A core wire-connecting device according to claim 22, wherein said wedge-inserting means comprises a rod type wedge-inserting member.

24. A core wire-connecting device according to claim 23, wherein said core cutting-off mechanism comprises the rod type wedge-inserting member having a cutting edge formed at the free end thereof and a die received in the annular groove close to the front receptacle at the second station and comprising another cutting edge defined by a hole formed in the die so as to be aligned with the wedge-inserting member and having substantially the same diameter as the diameter of the wedge-inserting member and a conical surface formed in the die and facing the wedge-inserting member.

25. A core wire-connecting device according to claim 24, wherein said conical surface of the die is formed in eccentric relationship to the hole of the die on that side of the sleeves to which the joinable end portions of the core wires extending out of the sleeve are radially pulled, and the cutting edge of the wedge-inserting member is provided on that side of the free end of the wedge-inserting member to which the joinable end portions of the core wires are pulled.

26. A core wire-connecting device according to claim 24, wherein said core-bending member has an inclined plane formed at the end of that side of the core-bending member to which the joinable end portions of the core wires are pulled, said inclined plane being complementary to the conical surface of the die.

27. A core wire-connecting ending device according to claim 2, wherein said reciprocating means comprises a cylindrical cam securely mounted on the driving shaft and having a substantially helical endless groove formed in the periphery thereof and a roller rotatably mounted on the movable housing to engage said endless groove.

28. A core wire-connecting device according to claim 1, wherein said core cutting-off mechanism comprises a fixed cutting member fixed on the movable housing so as to have its blade positioned in the second station of the movable housing close to said one end of the rotor on the peripheral surface thereof; a movable cutting member normally positioned outside of the rotor beyond the fixed cutting member and provided with a blade at the end facing the blade of the fixed cutting member; a cam rotated by the driving shaft; and a lever urged by the cam so as to move the movable cutting member until the blade thereof is brought close to the central axis of the front receptacle at the second station of the movable housing.

29. A core wire-connecting device according to claim 28, further comprising a core stop movable toward the movable cutting member and provided with an arcuate depressed end for receiving the ends of core wires on that side of the core stop which faces said movable cutting member; a second cam rotated by the driving shaft; and a lever urged by the second cam so as to normally locate the core stop at such a point as causes the arcuate depressed end of the core stop to align with the front receptacle at the second station of the movable housing, but, depending on the rotation of said second cam, carrying the core stop away from the front receptacle.

30. A core wire-connecting device according to claim 1, wherein said core-holding unit comprises a fixed core-holding element provided at said one end of the rotor at the second station of the movable housing in immovable relationship to the fixed housing; a movable core-holding element facing the fixed core-holding element so as to be approachable thereto; a cam rotated by the driving shaft; and a lever engaging said cam to be urged thereby and drawing the movable core-holding element near the fixed core-holding element, thereby causing both core-holding elements to clamp the joinable end portions of the core wires.

31. A core wire-connecting device according to claim 1, further comprising a rotation unit formed of a generally circular plate member provided at said one end of the rotor and set immovable in the axial direction of the main shaft, but rotatable therewith and further provided with depressions which align with the corresponding front receptacles.

32. A core wire-connecting device according to claim 31, further comprising a core end-restricting mechanism formed of a core-restricting element for elastically blocking the depression of the core stop at the second station of the movable housing when the main shaft is not rotated and a compression spring for urging said core end-restricting element toward the depression of the core stop.

33. A core wire-connecting device according to claim 1, wherein said connector-feeding mechanism comprises connector-disengaging means for releasing the connector from the corresponding container of the magazine and placing the connector in the receptacle at the first station of the movable housing and magazine-moving means for carrying the magazine to an extent corresponding to an interval between the adjacent containers of the magazine while the connector-disengaging means is not operated.

34. A core wire-connecting device according to claim 33, wherein said connector-disengaging means comprises a connector-disengaging element for reciprocating in alignment with the receptacle at the first station of the movable housing and the corresponding one of the containers of the magazine brought to rest; an end cam fixed to the driving shaft; and a connector-disengaging member, one end of which is operated by the end cam, and the other end of which is connected to the connector-disengaging element.

35. A core wire-connecting device according to claim 33, wherein said magazine-moving means comprises a pair of sprockets engageable with perforations formed in both lateral edge portions of the magazine; a sprocket-rotating shaft extending in parallel with the driving shaft to rotate the sprockets; and an intermittent rotation mechanism for coupling the driving shaft with the sprocket-rotating shaft and intermittently rotate the sprocket-rotating shaft to an extent corresponding to an interval between the adjacent containers of the magazine relative to the prescribed rotation angle of the driving shaft.

36. A core wire-connecting device according to claim 1, further comprising power supply means for rotating the driving shaft; and a clutch mechanism disposed between the driving shaft and power supply means, said clutch mechanism being formed of a clutch follower unit radially inserted into the driving shaft with one end of the clutch follower unit elastically urged to project out of the driving shaft, a control lever elastically urged toward the clutch follower unit with one end of the control lever pivoted to the driving shaft, the other end thereof projecting outwardly from the driving shaft and an end cam surface formed in that intermediate part of the control lever which is near the other end thereof an operation rod disposed radially apart from the driving shaft so as to reciprocate between an extreme position in a first direction perpendicular to the driving shaft and an extreme position in a second direction opposite to the first direction, said operation rod being normally elastically urged in the first direction to rest in the extreme position in the first direction, driving means for carrying the operation rod to the extreme position in the second direction, a stop member pivoted to the operation rod and provided with a first cam surface facing said one end of the clutch follower unit and, when the operation rod lies in the extreme position in the first direction, pressed against said one end of the clutch follower unit, thereby forcing said clutch follower unit into the driving shaft and, when the operation rod assumes the extreme position in the second direction, disengaged from the clutch follower unit, said stop member being also provided with a second cam surface engaging the end cam surface of the control lever so as to cause the member to force the clutch follower unit into the driving shaft and to cause the stop member to be separated from the clutch follower unit when the operation rod lies in the extreme position in the second direction, when the operation rod stands at the extreme position in the first direction and a cylindrical clutch driver unit disposed around the driving shaft, rotated by the power supply means and provided with a group of first grooved engaging elements equidistantly formed in the circumferential direction in one inner peripheral wall of the clutch driver unit and extending axially thereof so as to receive said one end of the clutch follower unit when the operation rod lies in the extreme position in the second direction and a group of second grooved engaging elements equidistantly formed in the circumferential direction in the other inner peripheral wall of the clutch driver unit and extending axially thereof so as to be engaged with said other end of the control lever, while the operation rod lies in the extreme position in the first direction and said one end of the clutch follower unit faces the other portions of said one inner peripheral wall of the cylindrical clutch driver unit than those in which the first engaging elements are formed.

* * * * *